US011143415B2

(12) United States Patent
Nilssen et al.

(10) Patent No.: US 11,143,415 B2
(45) Date of Patent: Oct. 12, 2021

(54) KITCHEN RACK

(71) Applicant: Hestan Commercial Corporation, Anaheim, CA (US)

(72) Inventors: Ray Nilssen, Fairhope, AL (US); Chris Moy, Monterey Park, CA (US); Eric Deng, Irvine, CA (US); Richard Zirges, Rancho Cucamonga, CA (US)

(73) Assignee: Hestan Commercial Corporation, Anaheim, CA (US)

( * ) Notice: Subject to any disclaimer, the term of this patent is extended or adjusted under 35 U.S.C. 154(b) by 123 days.

(21) Appl. No.: 16/230,407

(22) Filed: Dec. 21, 2018

(65) Prior Publication Data

US 2019/0120503 A1 Apr. 25, 2019

Related U.S. Application Data

(62) Division of application No. 14/968,330, filed on Dec. 14, 2015, now Pat. No. 10,161,638.

(60) Provisional application No. 62/091,285, filed on Dec. 12, 2014.

(51) Int. Cl.

| | |
|---|---|
| ***F24C 15/16*** | (2006.01) |
| ***F24C 1/14*** | (2021.01) |
| ***A47B 57/14*** | (2006.01) |

(52) U.S. Cl.

CPC ..... *F24C 15/166* (2013.01); *A47B 57/14* (2013.01); *F24C 1/14* (2013.01)

(58) Field of Classification Search

CPC ..... A47B 57/14; A47B 81/04; A47B 81/02; A47F 5/08; D06F 57/12

See application file for complete search history.

(56) References Cited

U.S. PATENT DOCUMENTS

| | | | |
|---|---|---|---|
| 1,922,585 | A | 8/1933 | Hoffstetter |
| 1,954,580 | A | 4/1934 | Toomey |
| 2,682,831 | A | 7/1954 | Pellegrin |
| 2,876,695 | A | 3/1959 | Racheter |
| 3,982,801 | A | 9/1976 | Heidorn |
| D321,804 | S | 11/1991 | Wolff |
| 5,069,350 | A | 12/1991 | Wolff |

(Continued)

FOREIGN PATENT DOCUMENTS

FR 2432064 A1 * 2/1980 ..... D06F 57/12

OTHER PUBLICATIONS

U.S. Appl. No. 14/968,330, filed Dec. 14, 2015.

*Primary Examiner* — Jason Lau
(74) *Attorney, Agent, or Firm* — Akerman LLP

(57) ABSTRACT

According to one embodiment, a rack includes a pair of spaced apart inverted U shaped brackets. Each bracket has a top portion coupled in-between a rear leg and a front leg and forming a gap in-between the rear leg and the front leg. The top portion, the rear leg, and front leg of each bracket are disposed in a first plane. The rack further includes one or more horizontal coupling members coupled in-between the pair of brackets. The horizontal coupling members and the front leg of each bracket are disposed in a second plane that is orthogonal to the first plane. The rack also includes one or more first horizontal supporting members coupled to and extending outward from a first bracket of the pair of brackets. The first horizontal supporting members are disposed in a third plane that is orthogonal to the first and second planes.

5 Claims, 15 Drawing Sheets

(56) References Cited

U.S. PATENT DOCUMENTS

| | | | | |
|---|---|---|---|---|
| 8,333,448 | B2 | 12/2012 | Yoon | |
| 8,800,785 | B2 | 8/2014 | Kalafut | |
| 8,985,032 | B1 | 3/2015 | Johnson | |
| 2006/0086352 | A1 | 4/2006 | Bally | |
| 2007/0261199 | A1* | 11/2007 | Petri | F24C 15/168 16/90 |
| 2008/0048081 | A1 | 2/2008 | Costa | |
| 2008/0203875 | A1* | 8/2008 | Lim | F25D 23/021 312/404 |
| 2009/0001069 | A1 | 1/2009 | Bally | |
| 2010/0117502 | A1 | 5/2010 | Kang | |
| 2014/0126129 | A1* | 5/2014 | Kyle | H05K 5/02 361/679.02 |
| 2014/0238279 | A1 | 8/2014 | Maas | |
| 2016/0169534 | A1 | 6/2016 | Nilssen et al. | |
| 2016/0201926 | A1 | 7/2016 | Evans | |

* cited by examiner

KITCHEN RACK

CROSS-REFERENCE TO RELATED APPLICATIONS

This patent application is a divisional of U.S. patent application Ser. No. 14/968,330, filed Dec. 14, 2015, which claims the benefit of the filing date under 35 U.S.C. § 119(e) to U.S. Provisional Patent Application No. 62/091,285, filed Dec. 12, 2014, the contents of both of which are hereby incorporated by reference in their entirety.

TECHNICAL FIELD

This disclosure relates generally to the field of racks and more specifically to a kitchen rack.

BACKGROUND

Traditionally, shelves, cabinets, drawers, and/or cooking appliances have been installed in a kitchen by bolting the shelves, cabinets, drawers, and/or cooking appliances to the floor of the kitchen, a riser (or other elevated structure) of the kitchen, a wall of the kitchen, or a vent flue of the kitchen. Such traditional installation techniques, however, may be deficient.

SUMMARY

A first aspect of the invention is achieved by providing a system comprising a vent flue comprising a cavity with an upper opening, the cavity being defined by at least a front wall and a back wall, the front wall being parallel to the back wall, the front wall extending upward to a first height, the back wall extending upward to a second height that is greater than the first height; and a horizontal support bar coupled to a rear face of the front wall at a location adjacent the first height of the front wall; and a rack comprising a pair of spaced apart inverted U shaped brackets, each U shaped bracket having a top portion coupled in-between a rear leg and a front leg and forming a gap in-between the rear leg and the front leg, wherein the top portion, the rear leg, and front leg of each U shaped bracket are disposed in a first plane; one or more horizontal coupling members coupled in-between the pair of U shaped brackets, wherein the one or more horizontal coupling members and the front leg of each U shaped bracket are disposed in a second plane that is orthogonal to the first plane; one or more first horizontal supporting members coupled to and extending outward from a first U shaped bracket of the pair of U shaped brackets, wherein the one or more first horizontal supporting members are disposed in a third plane that is orthogonal to the first and second planes; and one or more second horizontal supporting members coupled to and extending outward from a second U shaped bracket of the pair of U shaped brackets, wherein the one or more second horizontal supporting members are disposed in a fourth plane that is parallel to the third plane; wherein the pair of U shaped brackets of the rack are configured to be inserted into the upper opening of the cavity of the vent flue so that the second plane is oriented parallel to the front wall, and further so that the horizontal support bar of the vent flue is positioned within the gap in-between the rear leg and the front leg of each respective U shaped bracket.

Another aspect of the invention is any such system, further comprising a vent cap coupled on top of the vent flue so as to be located above the upper opening of the vent flue; and wherein, when the pair of U shaped brackets of the rack are inserted into the upper opening of the cavity of the vent flue, the rack is configured to be moved laterally along the vent flue without removing the vent cap from the vent flue.

A second aspect of the invention is achieved by providing a system, comprising a vent flue comprising a vertical cavity with an upper opening, the cavity being defined by at least a front wall and a back wall, the front wall being parallel to the back wall, the front wall having a rear face within the cavity and an opposing front face outside the cavity; a rack comprising a pair of spaced apart inverted U shaped brackets, each U shaped bracket having a top portion coupled in-between a rear leg and a front leg and forming a gap in-between the rear leg and the front leg, wherein the top portion, the rear leg, and front leg of each U shaped bracket are disposed in a first plane; one or more horizontal coupling members coupled in-between the pair of U shaped brackets, wherein the one or more horizontal coupling members and the front leg of each U shaped bracket are disposed in a second plane that is orthogonal to the first plane; one or more first horizontal supporting members coupled to and extending outward from a first U shaped bracket of the pair of U shaped brackets, wherein the one or more first horizontal supporting members are disposed in a third plane that is orthogonal to the first and second planes; and one or more second horizontal supporting members coupled to and extending outward from a second U shaped bracket of the pair of U shaped brackets, wherein the one or more second horizontal supporting members are disposed in a fourth plane that is parallel to the third plane; and wherein the rear leg of each pair of U shaped brackets of the rack is inserted into the upper opening of the cavity of the vent flue between the front wall and the back wall, and wherein the front leg of each pair of U shaped brackets is positioned against the front face of the front wall so that the second plane is oriented parallel to the front wall.

Another aspect of the invention is any such system, wherein the front wall of the vent flue extends upward to a first height, and the back wall extends upward to a second height that is greater than the first height.

Another aspect of the invention is any such system, further comprising a horizontal support bar coupled to the rear face of the front wall at a location adjacent the first height of the front wall so that the horizontal support bar of the vent flue is positioned within the gap in-between the rear leg and the front leg of each respective U shaped bracket.

Another aspect of the invention is any such system, further comprising a vent cap coupled on top of the vent flue so as to be located above the upper opening of the vent flue to provide a horizontal slot in-between an upper edge of the front wall of the vent flue and a bottom edge of the vent cap; and wherein the rack is configured to be moved laterally along the vent flue without removing the vent cap from the vent flue.

Another aspect of the invention is any such system, further comprising an oven positioned below the rack, wherein combustion gas from the oven is in fluid communication with the vent flue.

Another aspect of the invention is any such system, wherein the one or more first horizontal supporting members and the one or more second horizontal members are positioned above a top of the oven to leave a work space in-between the top of the oven and a lowest horizontal supporting member of the one or more first horizontal supporting members and a lowest horizontal supporting member of the one or more second horizontal supporting members.

Another aspect of the invention is any such system, wherein the vent flue extends laterally beyond one of the rack and the oven, and wherein the one or more first horizontal supporting members and the one or more second horizontal supporting members are positioned above the oven.

Another aspect of the invention is any such system, further comprising a shelf supported by a first of the one or more first horizontal supporting members and a first of the one or more second horizontal supporting members.

Another aspect of the invention is any such system, further comprising a second shelf supported by a second of the one or more first horizontal supporting members and a second of the one or more second horizontal supporting members.

Another aspect of the invention is any such system, further comprising a cooking appliance supported by a first of the one or more first horizontal supporting members and a first of the one or more second horizontal supporting members.

Another aspect of the invention is any such system, further comprising a food supporting shelf supported by a second of the one or more first horizontal supporting members and a second of the one or more second horizontal supporting members, the food supporting shelf being positioned underneath the cooking appliance for receiving radiant heat from the cooking appliance.

A third aspect of the invention is achieved by performing a method comprising providing a rack comprising a pair of spaced apart inverted U shaped brackets, each U shaped bracket having a top portion coupled in-between a rear leg and a front leg and forming a gap in-between the rear leg and the front leg, wherein the top portion, the rear leg, and front leg of each U shaped bracket are disposed in a first plane; one or more horizontal coupling members coupled in-between the pair of U shaped brackets, wherein the one or more horizontal coupling members and the front leg of each U shaped bracket are disposed in a second plane that is orthogonal to the first plane; one or more first horizontal supporting members coupled to and extending outward from a first U shaped bracket of the pair of U shaped brackets, wherein the one or more first horizontal supporting members are disposed in a third plane that is orthogonal to the first and second planes; and one or more second horizontal supporting members coupled to and extending outward from a second U shaped bracket of the pair of U shaped brackets, wherein the one or more second horizontal supporting members are disposed in a fourth plane that is parallel to the third plane; providing a vent flue with a vertical cavity having an upper opening, the cavity being defined by at least a front wall and a back wall, the front wall being parallel to the back wall, and having a rear face within the cavity and an opposing front face outside the cavity; inserting the rear leg of each of the pair of U shaped brackets in the upper opening of the vertical cavity of the vent flue so that the second plane is oriented parallel to the front wall; covering the vent flue with a vent cap; and moving the rack laterally along the vent flue.

Another aspect of the invention is any such method, wherein the first and second horizontal supporting members of the rack support one or more shelves.

Another aspect of the invention is any such method, wherein the first and second horizontal supporting members of the rack form or support one or more cabinets.

Another aspect of the invention is any such method, wherein the first and second horizontal supporting members of the rack form or support one or more cooking appliances.

Another aspect of the invention is any such method, wherein moving the rack laterally along the vent flue comprises sliding the rack laterally along the vent flue without removing the vent cap.

Another aspect of the invention is any such method, wherein the vent flue includes a horizontal slot in-between the front wall of the vent flue and the vent cap, and wherein moving the rack laterally along the vent flue comprises sliding the rack laterally along the horizontal slot in-between the front wall of the vent flue and the vent cap.

Another aspect of the invention is any such method, wherein the rear leg of each of the pair of U-shaped brackets is inserted between the front wall and the back wall of the vent flue, and wherein the front leg of each of the pair of U shaped brackets is positioned against the front face of the front wall of the vent flue.

A fourth aspect of the invention is achieved by providing a shelving system comprising a rack comprising a pair of spaced apart inverted U shaped brackets, each U shaped bracket having a top portion coupled in-between a rear leg and a front leg and forming a gap in-between the rear leg and the front leg, wherein the top portion, the rear leg, and front leg of each U shaped bracket are disposed in a first plane; one or more horizontal coupling members coupled in-between the pair of U shaped brackets, wherein the one or more horizontal coupling members and the front leg of each U shaped bracket are disposed in a second plane that is orthogonal to the first plane; one or more first horizontal supporting members coupled to and extending outward from a first U shaped bracket of the pair of U shaped brackets, wherein the one or more first horizontal supporting members are disposed in a third plane that is orthogonal to the first and second planes; and one or more second horizontal supporting members coupled to and extending outward from a second U shaped bracket of the pair of U shaped brackets, wherein the one or more second horizontal supporting members are disposed in a fourth plane that is parallel to the third plane; and a pair of shelf supporting members, a first shelf supporting member of the pair of shelf supporting members having a cavity configured to receive one of the one or more first horizontal supporting members, a second shelf supporting member of the pair of shelf supporting members having a cavity configured to receive one of the one or more second horizontal supporting members, wherein a lateral support surface spans a lateral space in-between the pair of shelf supporting members.

Another aspect of the invention is any such shelving system, wherein the pair of shelf supporting members each have an upper internal surface and a downward extending appendage extending from the upper internal surface, wherein each of the one of the one or more first horizontal supporting members and the one of the one or more second horizontal supporting members has a top surface with a recess positioned in the top surface, wherein each recess is configured to receive one of the downward extending appendages to latch the pair of shelf supporting members to the one of the one or more first horizontal supporting members and the one of the one or more second horizontal supporting members.

Another aspect of the invention is any such shelving system, wherein each of the one of the one or more first horizontal supporting members and the one of the one or more second horizontal supporting members comprises a bar having a hollow core and a respective recess extending into the hollow core.

Another aspect of the invention is any such shelving system, wherein the pair of shelf supporting members comprise laterally spaced apart sleeves, and wherein a plurality of spaced apart shelf members are coupled in-between the laterally spaced apart sleeves to form the lateral support surface.

Another aspect of the invention is any such shelving system, wherein each of at least a portion of the plurality of spaced apart shelf members has a circular cross section.

BRIEF DESCRIPTION OF THE FIGURES

For a more complete understanding of the present disclosure and its features and advantages, reference is now made to the following description, taken in conjunction with the accompanying drawings, in which.

DETAILED DESCRIPTION

Embodiments of the present disclosure are best understood by referring to FIGS. 1A-7 of the drawings, like numerals being used for like and corresponding parts of the various drawings.

Traditionally, shelves, cabinets, drawers, and/or cooking appliances have been installed in a kitchen by bolting the shelves, cabinets, drawers, and/or cooking appliances to the floor of the kitchen, a riser (or other elevated structure) of the kitchen, a wall of the kitchen, or a vent flue of a kitchen. Such traditional installation techniques, however, may be deficient. For example, it may be burdensome, time consuming, and/or expensive to change the configuration of the shelves, cabinets, drawers, and/or cooking appliances (or move the shelves, cabinets, drawers, and/or cooking appliances) after they have been installed in such traditional manners. In particular, such traditional installation techniques may require shelves, cabinets, drawers, and/or cooking appliances to be unbolted from their installation area, and re-bolted to a new area, if such a move is even possible. Not only can this cause damage to the kitchen and/or the shelves, cabinets, drawers, and/or cooking appliances, but it may also take a long time, which is inconvenient. Contrary to such typical deficiencies, the rack 100 of FIGS. 1A-4 may provide one or more advantages.

Figure 1A:
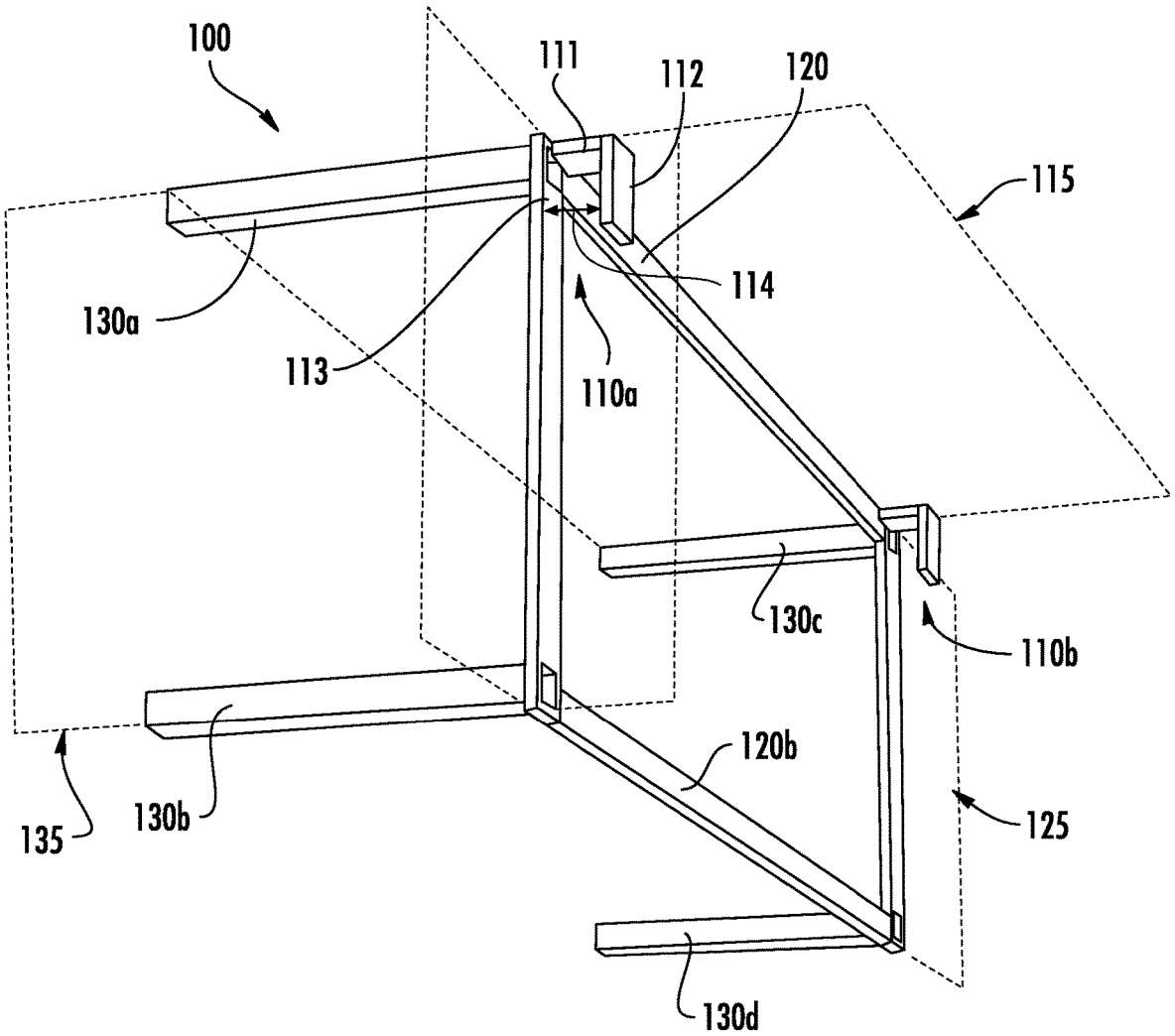
FIGS. 1A-1B illustrate an example kitchen rack.
Figure 1B:
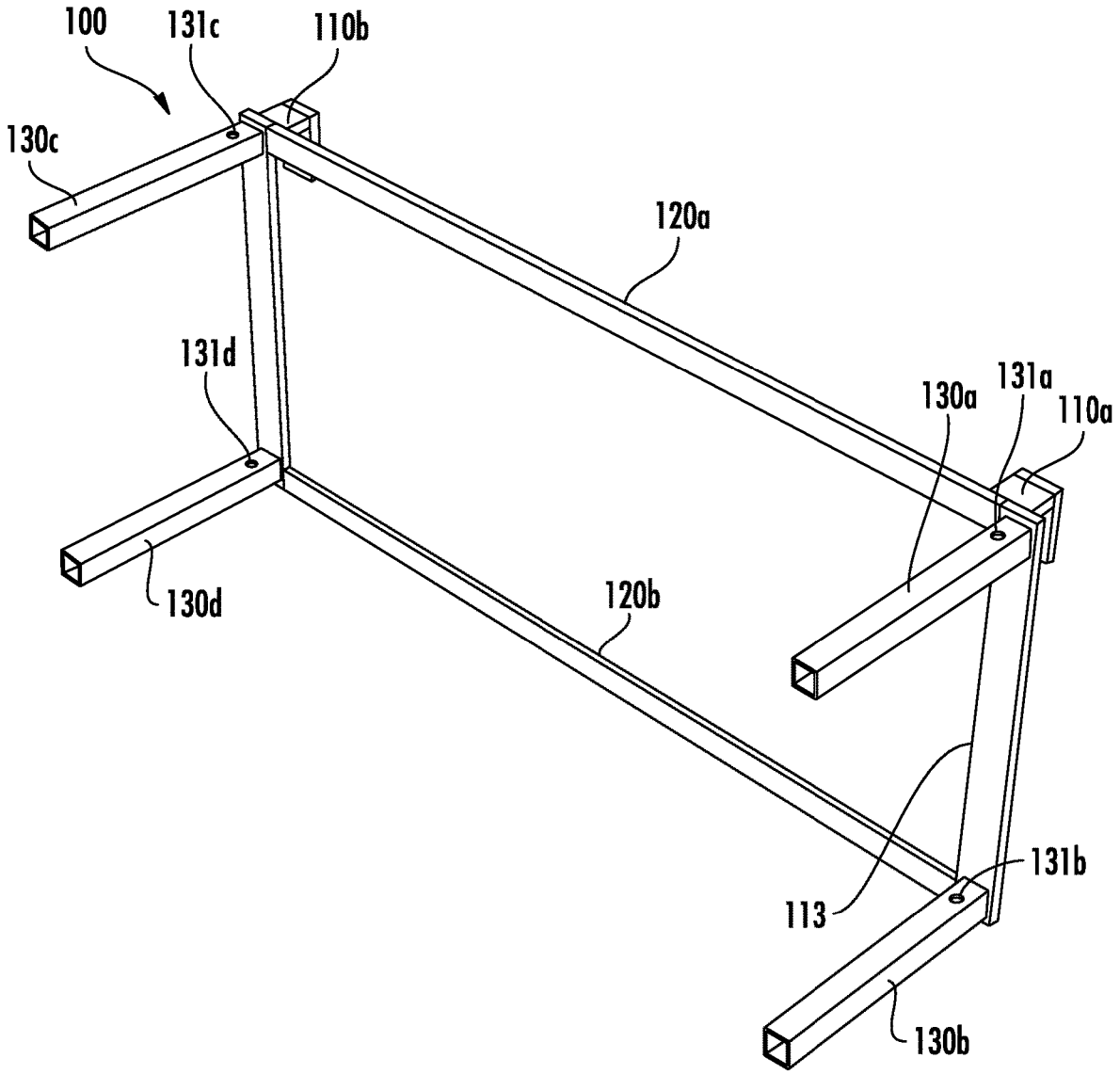

FIGS. 1A-1B illustrate an example kitchen rack. In particular, FIG. 1A illustrates a back perspective view of a rack 100, and FIG. 1B illustrates a front perspective view of the rack 100. As illustrated, the rack 100 includes brackets 110, coupling members 120, and supporting members 130. The coupling members 120 may be coupled in-between the brackets 110. The supporting members 130 may be coupled to and extend from the brackets 110. The supporting members 130 may support (or be a portion of) one or more kitchen features, such as shelves, cabinets, drawers, and/or cooking appliances, for example. Furthermore, the brackets 110 may be inserted into (or on) a kitchen structure, such as a vent flue. The brackets 110 may allow the rack 100 to be moved even after the rack is installed into (or on) a kitchen structure. For example, even after the rack 100 is inserted into a vent flue of a kitchen, the brackets 110 may allow the rack 100 to be moved laterally along the vent flue. As such, kitchen personnel may move the rack 100 when it is desirable to clear space in a particular location, and/or when the kitchen features of the rack 100 may be desired in a different location in the kitchen.

As is illustrated in FIGS. 1A-1B, the rack 100 include brackets 110. A bracket 110 may be any device for coupling (or otherwise connecting) the rack 100 to a structure. For example, a bracket 110 may be a bracket (such as an inverted U bracket, an inverted V bracket, or any other shaped bracket), a clip, a hook, a latching device, any other device for coupling (or otherwise connecting) the rack 100 to a structure, or any combination of the preceding. As illustrated, the bracket 110 is an inverted U shaped bracket.

The bracket 110 may have multiple parts. For example, as illustrated, the bracket 110 includes a top portion 111 coupled in-between a rear leg 112 and a front leg 113. The top portion 111, the rear leg 112, and the front leg 113 may have any shape. For example, one or more (or all) of the top portion 111, the rear leg 112, and the front leg 113 may have a side or a cross-section that is shaped as a rectangle, a square, an irregular shape, any other shape, or any combination of the preceding. The top portion 111, the rear leg 112, and the front leg 113 may also have any size. For example, the top portion 111 may have a length within a range of approximately (i.e., +/−0.5 inches) 1 inch to approximately 6 inches, the rear leg 112 may have a length within a range of approximately 2 inches to approximately 12 inches, and the front leg 113 may have a length within a range of approximately 10 inches to approximately 48 inches. As illustrated, the front leg 113 has a length that is equal to the height of the rack 100, while the top portion 111 and the rear leg 112 have lengths that are less than the length of the front leg 113. The length of the top portion 111 may form a gap 114 in-between the rear leg 112 and the front leg 113, as is illustrated in FIGS. 1A-1B. The gap 114 may allow the bracket 110 to be inserted into a structure (such as into a vent flue of a kitchen, as is illustrated in FIGS. 3-4).

The top portion 111 may be coupled to the rear leg 112 and the front leg 113 in any manner. For example, the top portion 111 may be bolted to the rear leg 112 and the front leg 113, screwed to the rear leg 112 and the front leg 113, nailed to the rear leg 112 and the front leg 113, clipped to the rear leg 112 and the front leg 113, welded to the rear leg 112 and the front leg 113, formed integral to the rear leg 112 and the front leg 113, coupled to the rear leg 112 and the front leg 113 in any other manner, or any combination of the preceding.

The top portion 111, rear leg 112, and the front leg 113 may be oriented in any manner. For example, the top portion 111, rear leg 112, and the front leg 113 may all be disposed in a first plane 115 (which is illustrated in FIG. 1A as laying against the top of the rack 100). In such an example, each of the top portion 111, rear leg 112, and the front leg 113 may have at least one surface that touches the first plane 115.

The rack 100 may include any number of brackets 110. For example, the rack 100 may include 1 bracket 110, 2 brackets 110, 3 brackets 110, 4 brackets 110, 10 brackets 110, 20 brackets 110, or any other number of brackets 110. As illustrated, the rack 100 includes 2 brackets 110 (bracket 110*a* and bracket 110*b*). The brackets 110 may be made of (or constructed of) any material. For example, the bracket 110 may be made of steel (such as heavy duty, thick gauge, high grade, and fully welded steel bars), stainless steel, aluminum, iron, brass, lead, any other metal or metal alloy, wood, plastic, any other material, or any combination of the preceding. Additionally, the bracket 110 may be hollow, or it may be solid.

The brackets 110 may couple the rack 100 to any structure. For example, the brackets 110 may couple the rack 100 to a structure associated with a kitchen, such as a kitchen vent flue, a kitchen table, a kitchen cabinet, a kitchen door, any other structure associated with a kitchen, or any combination of the preceding. As another example, the brackets 110 may couple the rack 100 to any other structure, whether or not the structure is associated with a kitchen. Additionally, the brackets 110 may allow the rack 100 to be moved even after the rack 100 is coupled to the structure. For example, by providing a secure coupling (without the use of bolts or any other permanent-type coupling), the brackets 110 may allow the rack 100 to be moved. In such an example, rack 100 may be moved laterally along the structure without uncoupling the rack 100 from the structure, as is illustrated by arrow 150 in FIG. 3A. Furthermore, the rack 100 may also be more easily uncoupled from the structure and moved to an entirely different structure (or to another section of the same structure).

The rack 100 further includes coupling members 120. A coupling member 120 may be any item for coupling (or otherwise connecting) the brackets 110 to each other in a spaced apart relation. For example, the coupling member 120 may be a bar, a rod, a slab, a pipe, a panel, a board, a segment, any other item for coupling (or otherwise connecting) the brackets 110 to each other in a spaced apart relation, or any combination of the preceding.

The rack 100 may include any number of coupling members 120. For example, the rack 100 may include 1 coupling member 120, 2 coupling members 120, 3 coupling members 120, 4 coupling members 120, 6 coupling members 120, 10 coupling members 120, 20 coupling members 120, or any other number of coupling members 120. As illustrated, the rack 100 includes 2 coupling members 120 (coupling member 120*a* and coupling member 120*b*). The coupling member 120 may be made of (or constructed of) any material. For example, the coupling member 120 may be made of steel, stainless steel, aluminum, iron, brass, lead, any other metal or metal alloy, wood, plastic, any other material, or any combination of the preceding. The coupling member 120 may be made of the same material as the brackets 110, or the coupling member 120 may be made of a different material. Additionally, the coupling member 120 may be hollow, or it may be solid.

The coupling member 120 may have any shape. For example, the coupling member 120 may have a side or cross-section that is shaped as a rectangle, a square, a circle, an irregular shape, any other shape, or any combination of the preceding. As illustrated, the coupling members 120 have sides and a cross section shaped as rectangles. The coupling member 120 may also have any size. For example, coupling member 120 may have a length within a range of approximately (i.e., +/−0.5 inches) 6 inches to approximately 60 inches. The length of the coupling member 120 may cause the brackets 110 coupled to the coupling member 120 to be spaced apart from each other. For example, as is illustrated in FIG. 1A, bracket 110*a* and bracket 110*b* are spaced apart from each other for a distance equal to the lengths of the coupling member 120*a* and the coupling member 120*b*.

The coupling member 120 may be coupled to the brackets 110 in any manner. For example, the coupling member 120 may be bolted to the brackets 110, screwed to the brackets 110, nailed to the brackets 110, clipped to the brackets 110, welded to the brackets 110, formed integral with the brackets 110, coupled to the brackets 110 in any other manner, or any combination of the preceding. The coupling member 120 may provide a coupling of any rigidity between the brackets 110. For example, the coupling member 120 may provide a rigid coupling between the brackets 110, which may prevent the brackets 110 from substantially moving in relation to each other. As another example, the coupling member 120 may provide a flexible coupling between the brackets 110, which may allow the brackets 110 to move in relation to each other.

The coupling member 120 may be oriented in any manner that may allow the coupling member 120 to couple the brackets 110 to each other in a spaced apart relation. For example, the coupling member 120 may be oriented horizontally, vertically, at any angle in-between horizontal and vertical, or any other angle. As illustrated in FIGS. 1A-1B, the coupling members 120 are oriented horizontally. Additionally, the coupling members 120 and the front leg 113 of each bracket 110 may be disposed in a second plane 125 (which is illustrated in FIG. 1A as positioned adjacent and parallel to the back of the rack 100). In such an example, each of the coupling members 120 and the front leg 113 of each bracket 110 may have at least one surface that touches the second plane 125. The second plane 125 may have any orientation with regard to the first plane 115. For example, the second plane 125 may be positioned at a 90 degree angle to the first plane 115 (i.e., orthogonal), a 80 degree angle to the first plane 115, a 70 degree angle to the first plane 115, a 100 degree angle to the first plane 115, a 110 degree angle to the first plane 115, or any other angle. As another example, the second plane 125 may be positioned at an approximately (i.e., +/−5 degrees) 90 degree angle to the first plane 115 (i.e., approximately orthogonal), an approximately 80 degree angle to the first plane 115, an approximately 70 degree angle to the first plane 115, an approximately 100 degree angle to the first plane 115, an approximately 110 degree angle to the first plane 115, or any other approximate angle. As illustrated, the second plane 125 is positioned orthogonal to the first plane 115.

The rack 100 also includes supporting members 130. A supporting member 130 may be any item that may support (or be a portion of) a feature included on the rack 100. For example, the supporting member 130 may be a bar, a rod, a slab, a pipe, a panel, a board, a segment, a portion of a casing, a portion of a sidewall, any other item that may support (or be a portion of) a feature included on the rack 100, or any combination of the preceding. A feature included on the rack 100 may include any type of feature. For example, the feature may be one or more kitchen features, such as shelves, cabinets, drawers, and/or cooking appliances.

The rack 100 may include any number of supporting members 130. For example, the rack 100 may include 1 supporting member 130, 2 supporting members 130, 3 supporting members 130, 4 supporting members 130, 6 supporting members 130, 10 supporting members 130, 20 supporting members 130, or any other number of supporting members 130. As illustrated, the rack 100 includes 4 supporting members 130 (supporting members 130*a*-130*d*). Furthermore, any number of the supporting members 130 may be coupled to any location on the rack 100. For example, the rack 100 may include supporting members 130 coupled to a first bracket 110*a* and supporting members 130 coupled to a second bracket 110*b*, as is illustrated in FIGS. 1A-1B. In such an example, the rack 100 may include any number of supporting members 130 coupled to a first bracket 110*a*, such as 1 supporting member 130, 2 supporting members 130, 3 supporting members 130, 4 supporting members 130, or any other number of supporting members 130. Furthermore, the rack 100 may include any number of supporting members 130 coupled to a second bracket 110*b*, such as 1 supporting member 130, 2 supporting members 130, 3 supporting members 130, 4 supporting members 130, or any other number of supporting members 130. As is illustrated in FIGS. 1A-1B, the rack 100 includes 2 supporting members 130 (i.e., supporting members 130*a* and 130*b*) coupled to the first bracket 110*a*, and 2 supporting members 130 (i.e., supporting members 130*c* and 130*d*) coupled to the second bracket 110*b*.

Additionally, the rack 100 may include groups of supporting members 130 that may all support (or be a portion of) a single feature, such as a single cooking appliance. The group of supporting members 130 may include 2 supporting members 130, 3 supporting members 130, 4 supporting members 130, or any other number of supporting members 130. As is illustrated in FIGS. 1A-1B, the rack 100 includes a first group of supporting members 130 (i.e., supporting member 130*a* coupled to bracket 110*a* and supporting member 130*c* coupled to bracket 110*b*) that may all support (or be a portion of) a single feature, such as a first cooking appliance. Furthermore, as is also illustrated in FIGS. 1A-1B, the rack 100 also includes a second group of supporting members 130 (i.e., supporting member 130*b* coupled to bracket 110*a* and supporting member 130*d* coupled to bracket 110*b*) that may all support (or be a portion of) a single feature, such as a second cooking appliance.

The supporting member 130 may be made of (or constructed of) any material. For example, the supporting member 130 may be made of steel, stainless steel, aluminum, iron, brass, lead, any other metal or metal alloy, wood, plastic, any other material, or any combination of the preceding. The supporting member 130 may be made of the same material as the brackets 110 and the coupling members 120, or the supporting member 130 may be made of a different material than one or more of the brackets 110 and the coupling members 120. Additionally, the supporting member 130 may be hollow, or it may be solid. A hollow supporting member 130 (such as a bar with a hollow core) may reduce the weight of the rack 100, for example.

The supporting member 130 may have any shape. For example, the supporting member 130 may have a side or a cross-section that is shaped as a rectangle, a square, a circle, an irregular shape, any other shape, or any combination of the preceding. As illustrated, the supporting members 130 have sides that are shaped as rectangles and cross-sections that are shaped as squares. The supporting member 130 may also have any size. For example, the supporting member 130 may have a length within a range of approximately (i.e., +/−0.5 inches) 6 inches to approximately 48 inches.

The supporting member 130 may be coupled to a bracket 110, as is illustrated in FIGS. 1A-1B. The supporting member 130 may be coupled to a bracket 110 in any manner. For example, the supporting member 130 may be bolted to the bracket 110, screwed to the bracket 110, nailed to the bracket 110, clipped to the bracket 110, welded to the bracket 110, formed integral with the bracket 110, coupled to the bracket 110 in any other manner, or any combination of the preceding. The supporting member 130 may be coupled to any portion of the bracket 110. For example, the supporting member 130 may be coupled to the top portion 111, the rear leg 112, or the front leg 113. As illustrated, the supporting member 130 is coupled to the front side of the front leg 113. Furthermore, although the supporting member 130 is illustrated as being coupled to the bracket 110, the supporting member 130 may additionally (or alternatively) be coupled to the coupling member 120. For example, the supporting member 130 may be coupled to both the bracket 110 and the coupling member 120, or may be coupled to only the coupling member 120.

The supporting member 130 may extend outward from the bracket 110 (and/or the coupling member 120). The supporting member 130 may extend from the bracket 110 (and/or the coupling member 120) at any angle. For example, the supporting member 130 may extend from the bracket 110 (and/or the coupling member 120) at a 90 degree angle (orthogonal), a 80 degree angle, a 70 degree angle, a 100 degree angle, a 110 degree angle, or any other angle. As another example, the supporting member 130 may extend from the bracket 110 (and/or the coupling member 120) at an approximately (i.e., +/−5 degrees) 90 degree angle (i.e., approximately orthogonal), an approximately 80 degree angle, an approximately 70 degree angle, an approximately 100 degree angle, an approximately 110 degree angle, or any other approximate angle. As illustrated, the supporting member 130 extends from the bracket 110 at a 90 degree angle.

The supporting member 130 may be oriented in any manner that may allow the supporting member 130 to support (or be a portion of) a feature. For example, the supporting member 130 may be oriented horizontally, vertically, at any angle in-between horizontal and vertical, or any other angle. As illustrated in FIGS. 1A-1B, the supporting members 130 are oriented horizontally.

Additionally, the supporting members 130 may be disposed in a plane. For example, supporting members 130*a* and 130*b* may be positioned in a third plane 135 (which is illustrated in FIG. 1A as positioned adjacent and parallel to the length of supporting members 130*a* and 130*b*), and supporting members 130*c* and 130*d* may be positioned in a fourth plane (not illustrated, but which is also positioned adjacent and parallel to the length of supporting members 130*c* and 130*d*). In such an example, each of the supporting members 130*a* and 130*b* may have at least one surface that touches the third plane 135, and each of the supporting members 130*c* and 130*d* may have at least one surface that touches the fourth plane. The third plane 135 may have any orientation with regard to the fourth plane. For example, the third plane 135 may be positioned parallel to the fourth plane. Additionally, the third plane 135 and the fourth plane may have any orientation with regard to the first plane 115 and/or the second plane 125. For example, the third plane 135 and the fourth plane may be positioned at a 90 degree angle to the first plane 115 and/or the second plane 125 (i.e., orthogonal), a 80 degree angle to the first plane 115 and/or the second plane 125, a 70 degree angle to the first plane 115 and/or the second plane 125, a 100 degree angle to the first plane 115 and/or the second plane 125, a 110 degree angle to the first plane 115 and/or the second plane 125, or any other angle. As another example, the third plane 135 and the fourth plane may be positioned at an approximately (i.e., +/−5 degrees) 90 degree angle to the first plane 115 and/or the second plane 125 (i.e., approximately orthogonal), an approximately 80 degree angle to the first plane 115 and/or the second plane 125, an approximately 70 degree angle to the first plane 115 and/or the second plane 125, an approximately 100 degree angle to the first plane 115 and/or the second plane 125, an approximately 110 degree angle to the first plane 115 and/or the second plane 125, or any other approximate angle. As illustrated, both the third plane 135 and the fourth plane are positioned orthogonal to both the first plane 115 and the second plane 125.

The supporting member 130 may further have a recess 131. The recess 131 may be an opening in the supporting member 130 that may allow a shelf, a cabinet, a drawer, a cooking appliance, any other kitchen feature, or any combination of the preceding to be coupled to the supporting member 130. The recess 131 may have any shape. For example, the recess 131 may be shaped as a rectangle, a square, a circle, an irregular shape, any other shape, or any combination of the preceding. The recess 131 may have any size. Furthermore, the recess 131 may extend into the supporting member 130 to any depth. For example, the recess 131 may extend all the way through the supporting member 130 (creating an opening on two opposing sides of the supporting member 130), into the middle of the supporting member 130 (such as into a hollow core of a hollow bar), or to any other depth of the supporting member 130. Further details regarding the recess 131 are discussed below with regard to the FIGS. 4A-4C.

Figure 2A:
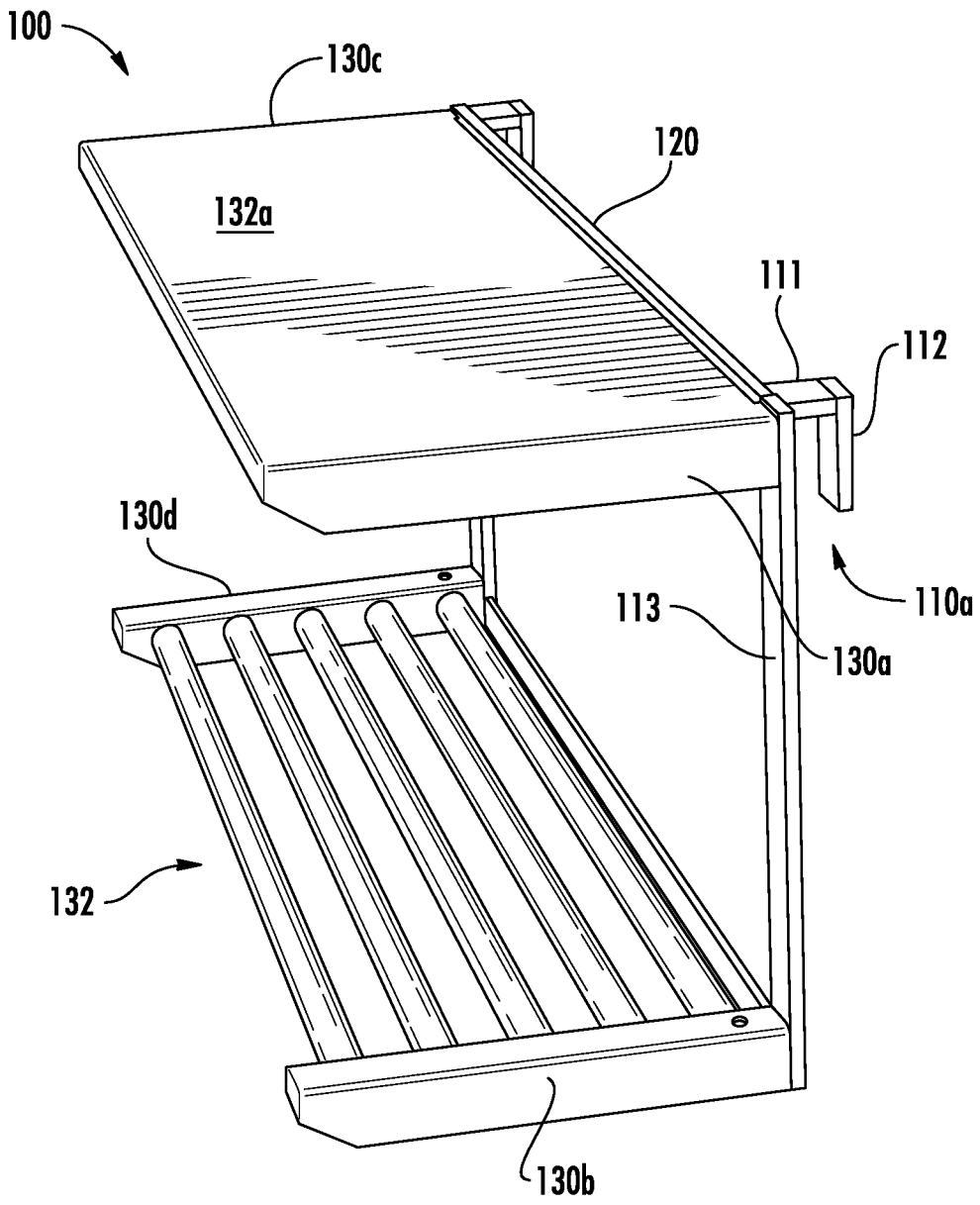
FIGS. 2A-2B illustrate an example of the kitchen rack of FIGS. 1A-1B with shelves.
Figure 2B:
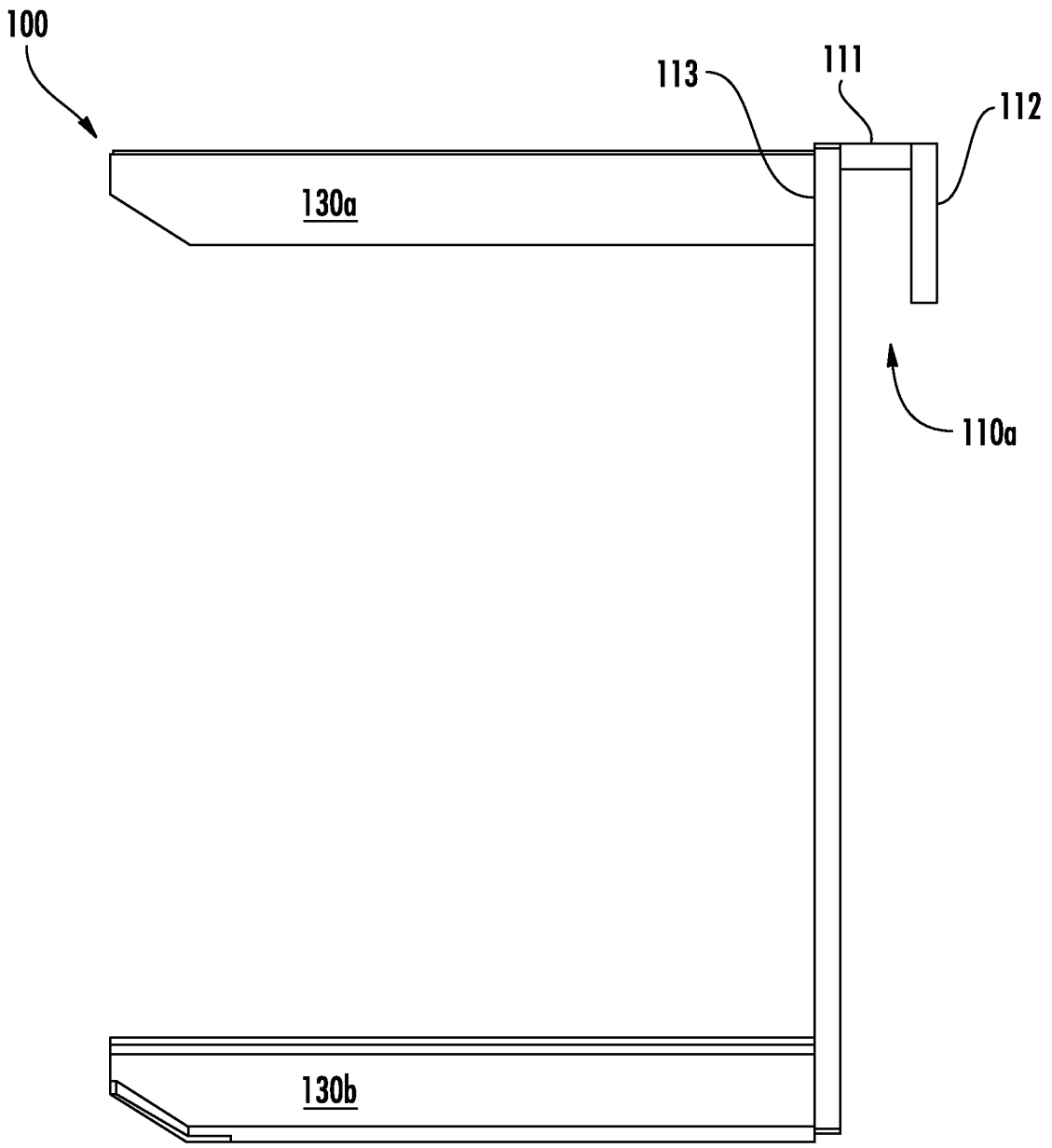

FIGS. 2A-2B illustrate an example of the kitchen rack of FIGS. 1A-1B with shelves. In particular, FIG. 2A illustrates a front perspective view of a rack 100 with shelves 132, and FIG. 2B illustrates a side view of the rack 100 with shelves 132. The rack 100 may be substantially similar to the rack 100 described above with regard to FIGS. 1A-1B. However, as illustrated, the rack 100 further includes shelves 132. A shelf 132 may be any surface that may be used for display and/or storage. For example, the shelf 132 may be a flat, horizontal surface that may be used for display and/or storage.

The shelf 132 may have any configuration. For example, the shelf 132 may be a solid surface, a surface with one or more gaps or holes in it, a mesh surface, two or more surfaces, a set of two or more bars (e.g., flat bars, circular bars), any other configuration, or any combination of the preceding. As illustrated, the shelf 132*a* is a solid surface, and the shelf 132*b* is a set of bars arranged parallel to each other. The shelf 132 may be modular, so as to allow it to be interchanged with other shelves 132 (or any other features, such as cooking appliances, cabinets, or drawers). For example, the solid shelf 132*a* may be interchanged with the shelf 132*b* having the set of bars arranged parallel to each other. The shelf 132 may be made of (or constructed of) any material. For example, the shelf 132 may be made of steel, stainless steel, aluminum, iron, brass, titanium, any other metal or metal alloy, including coated, plated and clad metals, wood, plastic, any other material, or any combination of the preceding, including laminates.

The rack 100 may include any number of shelves 132. For example, the rack 100 may include 1 shelf 132, 2 shelves 132, 3 shelves 132, 4 shelves 132, 6 shelves 132, 10 shelves 132, 20 shelves 132, or any other number of shelves 132. The number of shelves 132 included in rack 100 may be based on the number and/or configuration of supporting members 130 of the rack 100. For example, the rack 100 may include a single shelf 132 for each supporting member 130, or a single shelf 132 for each group (e.g., a pair) of supporting members 130. As illustrated, the rack 100 includes a first shelf 132*a* for supporting members 130*a* and 130*c*, and a second shelf 132*b* for supporting members 130*b* and 130*d*. Although the rack 100 has been illustrated as including only two supporting members 130 supporting (or forming a portion) of a shelf 132, the rack 100 may include any other number of supporting members 130 supporting (or forming a portion) of a shelf 132 (or any other feature). For example, the rack 100 may include one or more additional supporting members 130 positioned horizontally in-between supporting members 130*a* and 130*b*. These additional supporting members 130 may allow the shelf 132*a* to hold additional weight and/or allow the shelf 132*a* to have a longer length, for example.

The shelf 132 may have any shape and/or any size. The shape and/or size of the shelf 132 may be based on the size of the brackets 110, the coupling members 120, and the supporting members 130. For example, the shelf 132 may have a length that is based on both the length of the coupling members 120 and the width of the brackets 110, and may further have a depth that is based on the length of the supporting members 130.

The shelf 132 may be supported by supporting members 130, or the supporting members 130 may be a portion of the shelf 132. For example, the shelf 132 may be an attachment panel (or any other type of surface) that is coupled on top of, coupled below, coupled in-between, or inserted on the supporting members 130. In such an example, the supporting members 130 may support the shelf 132. Shelf 132*a* of FIGS. 2A-2B provides one example of a shelf 132 supported by supporting members 130. As another example, the shelf 132 may be a set of parallel bars (or any other type of surface), and the supporting members 130 may be a portion of the shelf 132. In such an example, the supporting members 130 may form an outside portion of the shelf 132, with the parallel bars (or any other type of surface) forming the remaining portion of the shelf 132. Shelf 132*b* of FIGS. 2A-2B provides one example of a shelf 132 with supporting members 130 that form portions of the shelf 132.

Figure 3A:
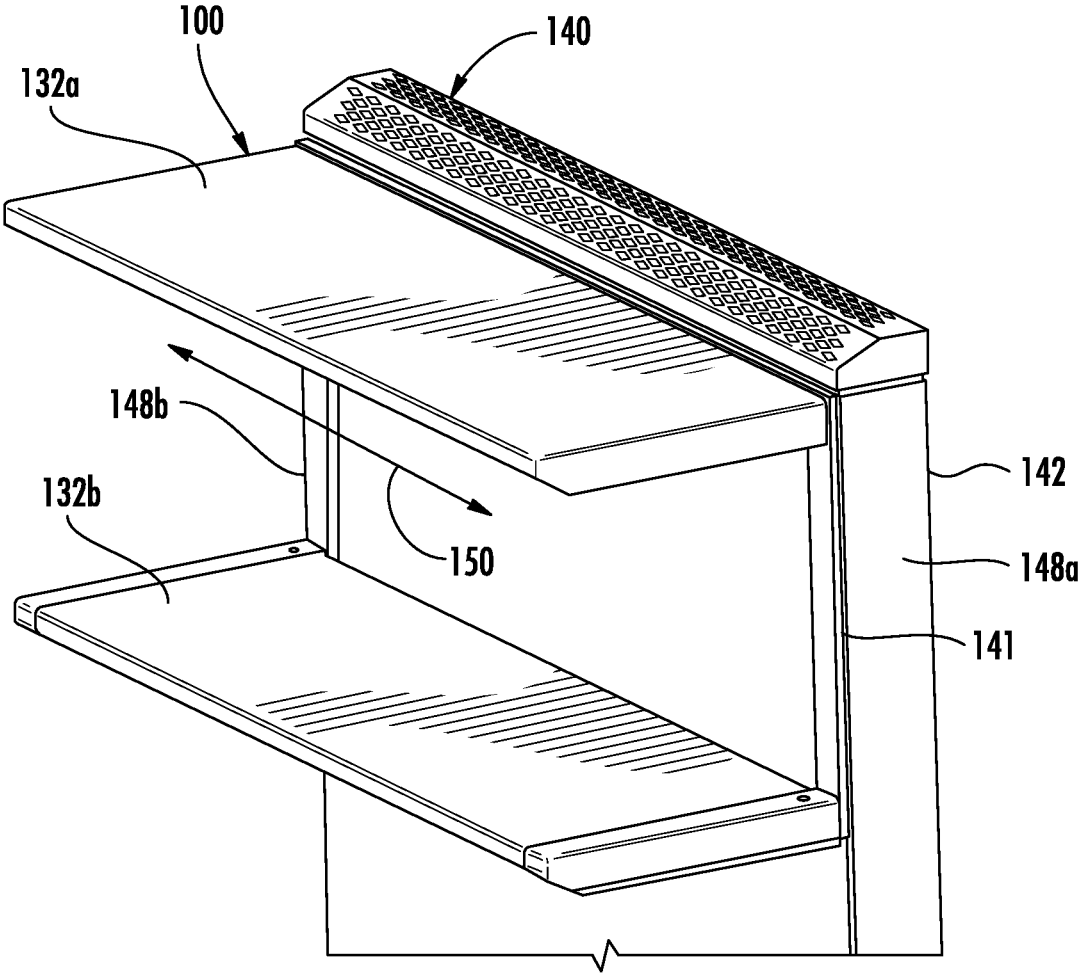
FIGS. 3A-3E illustrate an example of the kitchen rack of FIGS. 1A-1B coupled to a vent flue.
Figure 3B:
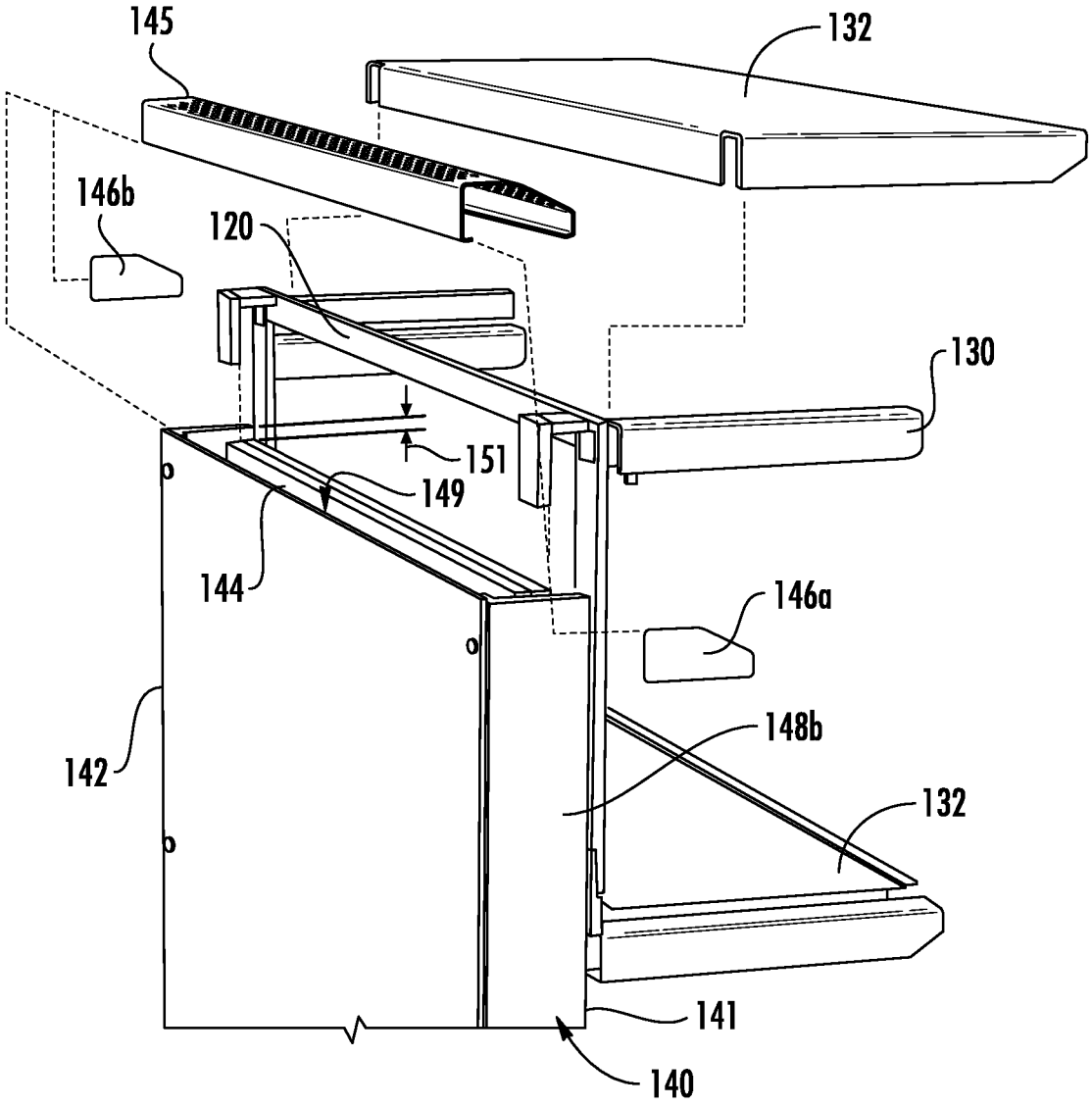
Figure 3C:
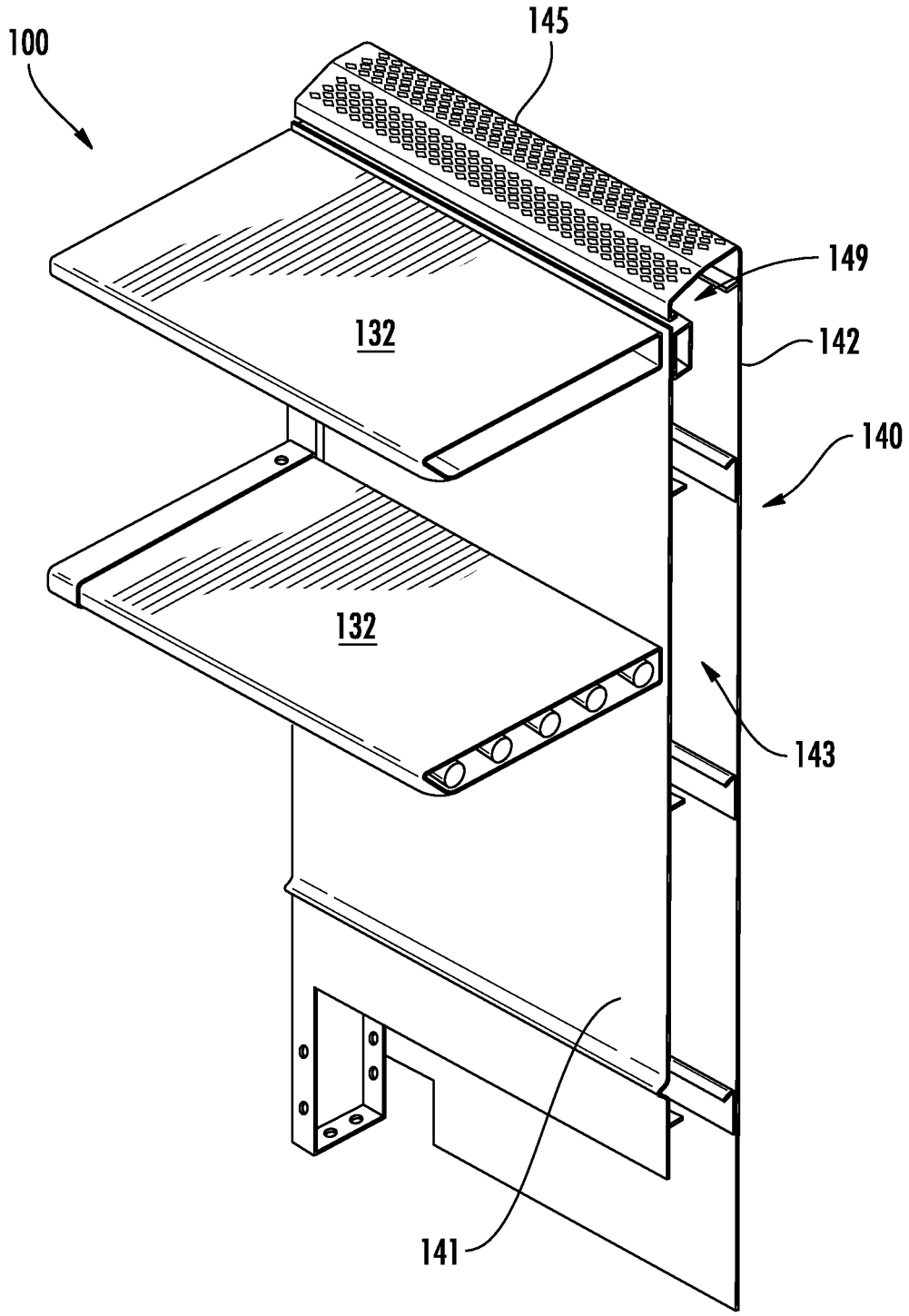
Figure 3D:
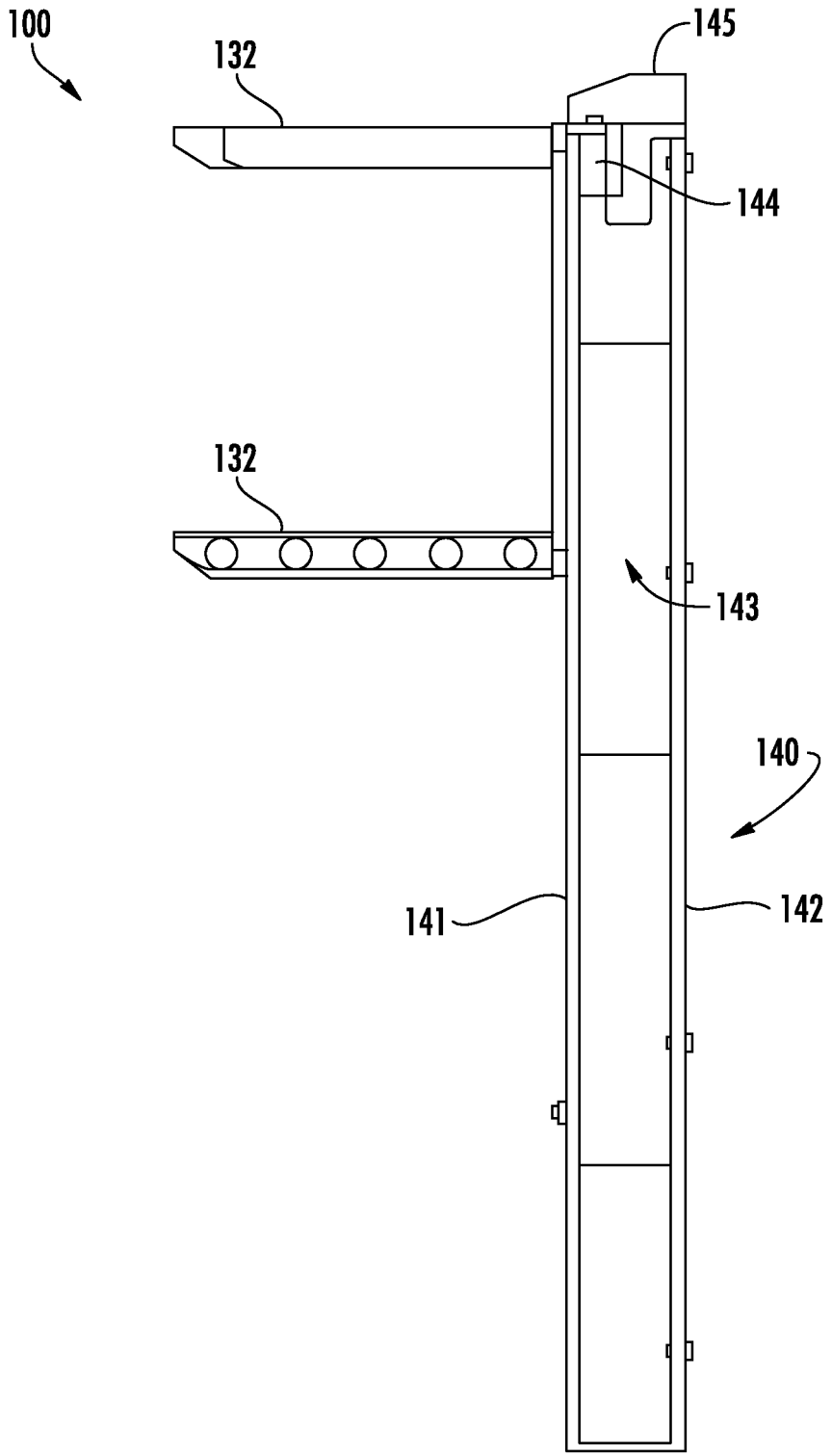
Figure 3E:
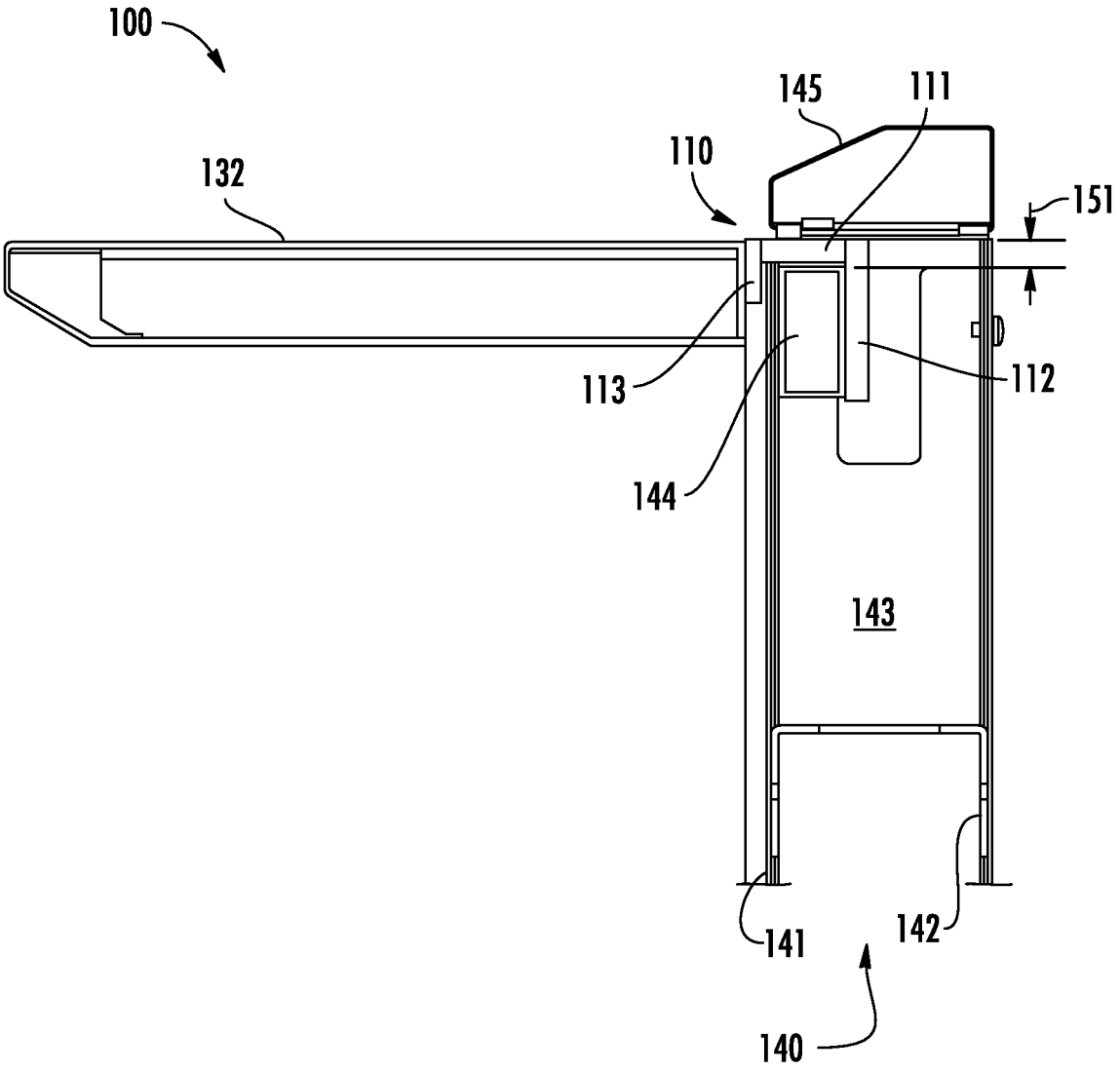

FIGS. 3A-3E illustrate an example of the kitchen rack of FIGS. 1A-1B coupled to a vent flue. In particular, FIG. 3A illustrates a front perspective view of a rack 100 coupled to a vent flue 140; FIG. 3B illustrates an exploded back perspective view of the rack 100 coupled to the vent flue 140; FIG. 3C illustrates a front cut-away perspective view of the rack 100 coupled to the vent flue 140; FIG. 3D illustrates a cross-sectional view of FIG. 3C; and FIG. 3E illustrates an enlarged cross-sectional view of a portion of FIG. 3C.

The rack 100 of FIGS. 3A-3E may be substantially similar to the rack 100 described above with regard to FIGS. 1-2. However, as illustrated, the rack 100 is coupled to a vent flue 140. The vent flue 140 may be any apparatus for venting gases. For example, the vent flue 140 may be a duct that receives hot combustion exhaust gases from one or more cooking appliances and vents the exhaust gases near ceiling vents in, for example, a kitchen. The vent flue 140 may receive gases from any number of cooking appliances.

As illustrated, the vent flue 140 has a cavity 143 (illustrated in FIGS. 3C-3E) with an upper opening 149 (illustrated in FIGS. 3B-3C) that may receive the brackets 110 when the rack 100 is coupled to the vent flue 140. The cavity 143 may have any size and/or shape. For example, the cavity 143 may have a rectangular cross-section with a length within a range of approximately (i.e., +/−0.5 inches) 6 inches to approximately 96 inches or greater, and a width (or depth) within a range of approximately (i.e., +/−0.5 inches) 3 inches to approximately 24 inches. As illustrated, the cavity 143 is a vertical cavity.

The cavity 143 may be defined by a front wall 141, a back wall 142, and two side walls 148. The front wall 141, back wall 142, and two side walls 148 may have any orientation with regard to each other. For example, the front wall 141 may be parallel to the back wall 142, the front wall 141 may be approximately (i.e., +/−5 degrees) parallel to the back wall 142, the front wall 141 and the back wall 142 may be oriented vertically away from each other in a V shape, the front wall 141 and the back wall 142 may be oriented vertically toward each other in an inverted V shape, any other orientation, or any combination of the preceding. Side walls 148 may be parallel to each other, approximately (i.e., +/−5 degrees) parallel to each other, any other orientation, or any combination of the preceding. Furthermore, side walls 148 may be oriented at 90 degree angles to each of the front wall 141 and the back wall 142, at 80 degree angles to each of the front wall 141 and the back wall 142, at 100 degree angles to each of the front wall 141 and the back wall 142, at approximately (i.e., +/−5 degrees) 90 degree angles to each of the front wall 141 and the back wall 142, at approximately 80 degree angles to each of the front wall 141 and the back wall 142, at approximately 100 degree angles to each of the front wall 141 and the back wall 142, any other angle, or any other approximate angle. As illustrated, the front wall 141 may have a rear face (or surface) within the cavity 143, and an opposing front face (or surface) outside of the cavity 143.

The front wall 141, back wall 142, and two side walls 148 may have any size. For example, the front wall 141 (and back wall 142) may have a length within a range of approximately (i.e., +/−0.5 inches) 6 inches to approximately 96 inches or more. Furthermore, the front wall 141 may have a length large enough to fit the rack 100 entirely within the length of the front wall 141. Additionally, the front wall 141 may have a length that is larger than the rack 100. In such an example, this may allow the rack 100 to be moved laterally (as is illustrated by arrow 150) along the length of the front wall 141 while the rack 100 is coupled to the vent flue 140. The front wall 141 may extend upward to a first height and the back wall 142 may extend upward to a second height that is larger than the first height. This difference in height may create a height gap 151 (illustrated in FIGS. 3B and 3E). The height gap 151 may be any size. For example, the size of the height gap 151 may be within a range of approximately (i.e., +/−0.1 inches) 0.25 inches to approximately 6 inches. The size of the height gap 151 may be based on the size of the top portion 111 of the brackets 110. For example, the size of the height gap 151 may be equal to or approximately (i.e., +/−0.5 inches) equal to the thickness of the top portion 111 of the brackets 110. In such an example, the brackets 110 may be inserted into the upper opening 149 of the cavity 143 of the vent flue 140, and the thickness of the top portion 111 may cause the top side of the top portion 111 to be level or approximately (i.e., +/−0.5 inches) level with the second height of the back wall 142. The height gap 151 may provide a space that allows the brackets 110 (and the rack 100) to be moved laterally (shown as arrow 150) along the length of the vent flue 140. For example, the height gap 151 (along with the vent cap 145 discussed below) may create a continuous horizontal slot that allows the rack 100 to be moved laterally without interference.

The front wall 141, back wall 142, and two side walls 148 may be made of (or constructed of) any material. For example, the front wall 141, back wall 142, and two side walls 148 may be made of steel, stainless steel, aluminum, iron, brass, titanium, any other metal or metal alloy including coated, plated or clad metals, plastic, cement, brick, laminates, any other material, or any combination of the preceding.

The vent flue 140 further includes a support bar 144 positioned within the cavity 143. The support bar 144 may be any item for coupling (or otherwise connecting) to the vent flue 140 and further for supporting the rack 100 when the rack 100 in inserted into the cavity 143. For example, the support bar 144 may be a bar, a rod, a slab, a pipe, a panel, a board, a segment, any other item for coupling (or otherwise connecting) to the vent flue 140 and further for supporting the rack 100 when the rack 100 in inserted into the cavity 143.

The vent flue 140 may include any number of support bars 144. For example, the vent flue 140 may include 1 support bar 144, 2 support bars 144, 3 support bars 144, 4 support bars 144, or any other number of support bars 144. As illustrated, the vent flue 140 includes 1 support bar 144. The support bar 144 may be made of (or constructed of) any material. For example, the support bar 144 may be made of steel, stainless steel, aluminum, iron, brass, titanium, any other metal or metal alloy, including plated, coated or clad metals, wood, plastic, any other material, or any combination of the preceding, including laminates. Additionally, the support bar 144 may be hollow, or it may be solid. As illustrated in FIG. 3E, the support bar 144 is hollow, thereby allowing the support bar 144 to achieve a high stiffness at a lower mass.

The support bar 144 may have any shape. For example, the support bar 144 may have a side or cross-section that is shaped as a rectangle, a square, a circle, an irregular shape, any other shape, or any combination of the preceding. As illustrated, the cross section of the support bar 144 is shaped as a rectangle. The support bar 144 may also have any size for supporting the rack 100 when the rack 100 in inserted into the cavity 143. For example, the support bar 144 may have a thickness within a range of approximately (i.e., +/−0.5 inches) 1 inch to approximately 6 inches. The thickness of the support bar 144 may be based on both the size of the gap 114 of the brackets 110 and the thickness of the front wall 141. For example, the thickness of the support bar 144 may be equal to or approximately (i.e., +/−0.5 inches) equal to the size of the gap 114 of the brackets 110, minus the thickness of the front wall 141. In such an example, the support bar 144 may fit within the gap 114 of the brackets 110, entirely (or approximately) filling the portion of the gap 114 of the brackets 110 that is not already filled by the thickness of the front wall 114 (as is illustrated in FIG. 3E). As such, the support bar 144 may distribute the stress caused by the load of the rack 100 when the rack 100 is coupled to the vent flue 140.

The support bar 144 may be positioned at any location within the cavity 143. For example, the support bar 144 may be coupled to the rear face of the front wall 141 of the vent flue 140. The support bar 144 may also be positioned at any height within the cavity 143. For example, the support bar 144 may be coupled adjacent to the first height of the front wall 141. In such an example, the top surface of the support bar 144 may be level or approximately (i.e., +/−0.1 inches) level with the top surface of the front wall 141, as is illustrated in FIG. 3B.

The support bar 144 may be coupled to the vent flue 140 (such as the rear face of the front wall 141 of the vent flue 140) in any manner. For example, the support bar 144 may be bolted to the vent flue 140, screwed to the vent flue 140, riveted to the vent flue 140, clipped or snapped into the vent flue 140, welded to the vent flue 140, bonded to the vent flue 140, formed integral with the vent flue 140, coupled to the vent flue 140 (such as the rear face of the front wall 141 of the vent flue 140) in any other manner, or any combination of the preceding.

The support bar 144 may be oriented in any manner that may allow the support bar 144 to support the rack 100 when the rack 100 is inserted into the cavity 143. For example, the support bar 144 may be oriented horizontally, vertically, at any angle in-between horizontal and vertical, or any other angle. As illustrated, the support bar 144 is oriented horizontally.

As illustrated, the vent flue 140 further includes a vent cap 145 coupled to the vent flue 140. The vent cap 145 may be any apparatus that may allow gases to vent out of the cavity 143. The vent cap 145 may have one or more perforations that may allow the gases to pass through the vent cap 145. The vent cap 145 may have any number of perforations, and the perforations may have any shape and/or size. Furthermore, the perforations may be angled so as to direct the gases out of the vent cap 145 at a particular angle.

The vent cap 145 may be coupled to the vent flue 140 at any location that allows the vent 145 to vent exhaust gases out of the cavity 143. For example, as is illustrated, the vent cap 145 may be coupled on top of the vent flue 140 so as to be located above the upper opening 149 of the cavity 143 of the vent flue 140. The vent cap 145 may be coupled to the vent flue 140 (such as the top of the vent flue 140) in any manner. For example, the vent cap 145 may be bolted to the vent flue 140, screwed to the vent flue 140, riveted to the vent flue 140, clipped to the vent flue 140, welded to the vent flue 140, formed integral with the vent flue 140, bonded to the vent flue 140 (such as the top of the vent flue 140) in any other manner, or any combination of the preceding.

Although the vent cap 145 may be coupled to the vent flue 140, such a coupling preferably does not block, cover, or otherwise impede a portion of the height gap 151 in-between the first height of the front wall 141 and the second height of the back wall 142. For example, the height gap 151 (or a portion of the height gap 151) may create a spacing in-between the top edge (or surface) of the front wall 141 and the bottom edge (or surface) of the vent cap 145. This spacing may create a continuous horizontal slot that allows the rack 100 to be coupled to the vent flue 140. As such, the vent flue 140 may include the vent cap 145 even when the rack 100 is coupled to the vent flue 140. Furthermore, this horizontal slot may also allow the rack 100 to be moved laterally (as is illustrated by arrow 150) along the length of the vent flue 140 even while the vent cap 145 is coupled to the vent flue 140. As such, the rack 100 may be moved (or repositioned) without the vent cap 145 having to be removed.

As illustrated, the vent cap 145 includes cap sides 146 (illustrated in FIG. 3B) coupled to each side of the vent cap 145. These cap sides 146 may allow the vent cap 145 to enclose the cavity 143 (other than the height gap 151 in-between the first height of the front wall 141 and the second height of the back wall 142). As such, all (or substantially all) of the gases in the cavity 143 may be vented through the perforations of the vent cap 145. The cap sides 146 may be coupled to the vent cap 145 in any manner. For example, the cap sides 146 may be bolted to the vent cap 145, screwed to the vent cap 145, riveted to the vent cap 145, clipped or snapped to the vent cap 145, welded to the vent cap 145, bonded to the vent cap 145, formed integral with the vent cap 145, coupled to the vent cap 145 in any other manner, or any combination of the preceding.

As is discussed above, the rack 100 may be coupled to the vent flue 140. The rack 100 may be coupled to the vent flue 140 in any manner. For example, the rack 100 may be coupled to the vent flue 140 by inserting the brackets 110 of the rack 100 into the upper opening 149 of the cavity 143 of the vent flue 140. By doing so, the rear leg 112 of the bracket 110 may be inserted between the front wall 141 and the back wall 142 of the vent flue 140, and be positioned against the back surface of the support bar 144, as is illustrated in FIG. 3E. Additionally, the support bar 144 may be positioned within the gap 114 in-between the rear leg 112 and the front leg 113, as is also illustrated in FIG. 3E. Furthermore, the front leg 113 of the bracket 110 may be positioned against the front face of the front wall 141, and the top portion 111 of the bracket 110 may be positioned against the top surface of the front wall 141 and the top surface of the support bar 144, as is also illustrated in FIG. 3E. Such a coupling may cause the coupling members 120 to be positioned against the front face of the front wall 141, thereby causing the second plane 125 (in which the coupling members 120 and the front legs 113 are disposed) to be oriented parallel to the front wall 141.

The rack 100 may be coupled to the vent flue 140 before the vent cap 145 is coupled to the vent flue 140. In such an example, after the rack 100 is coupled to the vent flue 140, the vent cap 145 may be coupled to the vent flue 140.

Although FIGS. 3A-3E illustrate the rack 100 coupled to a vent flue 140, the rack 100 may be coupled to any other structure associated with a kitchen. For example, the rack 100 may be coupled to a kitchen table, a kitchen cabinet, any other structure associated with a kitchen, or any combination of the preceding. Furthermore, the rack 100 may also be coupled to any other structure, whether or not the structure is associated with a kitchen.

Figure 4A:
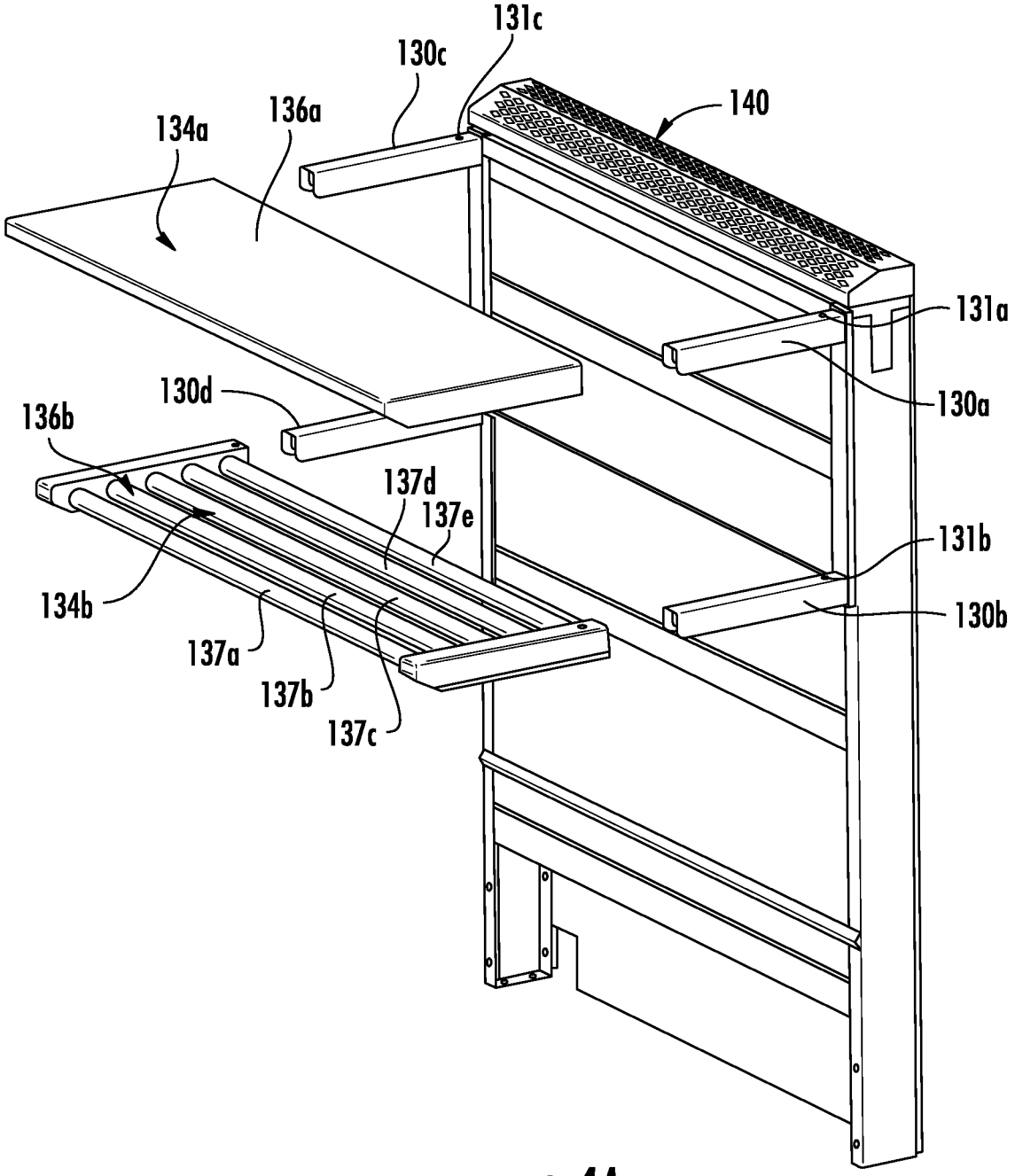
FIGS. 4A-4C illustrate an example of the kitchen rack of FIGS. 1A-1B with another example of shelves, and where the kitchen rack is coupled to a vent flue.
Figures 4B, 4C:
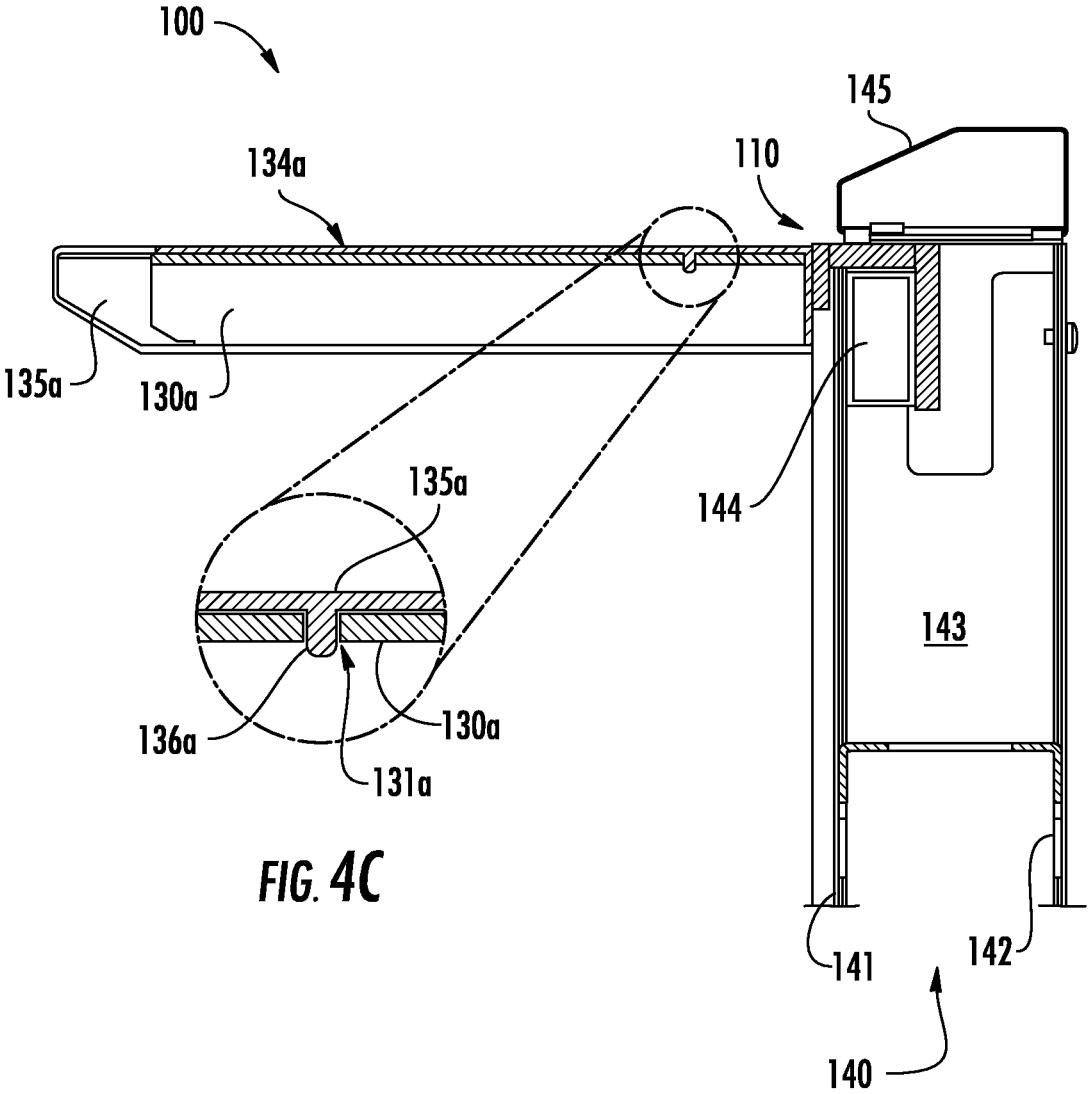

FIGS. 4A-4C illustrate an example of the kitchen rack of FIGS. 1A-1B with another example of shelves, and where the kitchen rack is coupled to a vent flue. In particular, FIG. 4A illustrates an exploded front perspective view of a rack 100 with shelves 134, where the rack 100 is coupled to a vent flue 140; FIG. 4B illustrates an enlarged cross-sectional view of a portion of FIG. 4A; and FIG. 4C illustrates an enlarged cross-sectional view of a portion of FIG. 4B.

The rack 100 may be substantially similar to the rack 100 described above with regard to FIGS. 1A-3E. Furthermore, the vent flue 140 may be substantially similar to the vent flue 140 described above with regard to FIGS. 3A-3E. However, as illustrated, the rack 100 further includes a shelf 134.

A shelf 134 may be any structure that may be used for display and/or storage. The shelf 134 may have multiple parts. For example, the shelf 134 may have shelf supporting members 135 and a support surface 136.

A shelf supporting member 135 may be any device for coupling (or otherwise connecting) the shelf 134 to the supporting members 130 of the rack 100. For example, a shelf supporting member 135 may be a sleeve, a hollow bar, a hollow rod, a latching device, any other device for coupling (or otherwise connecting) the shelf 134 to the supporting members 130 of the rack 100, or any combination of the preceding. As illustrated, the shelf supporting member 135 is a sleeve that may be positioned over (or around) a supporting member 130 of the rack 100 (causing the supporting member 130 to be received or inserted in a cavity (or other opening) within the sleeve of the shelf supporting member 135). In such an example, the sleeve may at least partially surround the supporting member 130 of the rack. This surrounding sleeve may further reinforce the supporting member 130 (which may be hollow, as is discussed above).

The shelf supporting member 135 may be positioned on a supporting member 130 in order to couple the shelf supporting member 135 to the supporting member 130. The shelf supporting member 135 may be positioned on the supporting member 130 in any manner. For example, the shelf supporting member 135 may be a sleeve or any other hollow structure (such as a hollow bar) that may be sized and/or shaped to fit over the supporting member 130. In such an example, the shelf supporting member 135 may be slid (or otherwise moved) onto and along the supporting member 130. As a result of such a sliding (or other movement), the supporting member 130 may be received in a cavity (or a hollow core) of the shelf supporting member 135, thereby coupling the shelf supporting member 135 to the supporting member 130.

The shelf supporting member 135 may include an appendage 136 that may further couple (or latch) the shelf supporting member 135 to the supporting members 130 of the rack 100. For example, when the shelf supporting member 135 is positioned over (or around) a supporting member 130 of the rack 100 (for example), the appendage 136 may be inserted into the recess 131 of the supporting member 130, as is illustrated in FIG. 4C. Such an insertion may occur when the shelf supporting member 135 is slid (or otherwise moved) over the supporting member 130 so that the appendage 136 is vertically above the recess 131, and gravity and the weight of the rack 100 causes the appendage 136 to fall into the recess 131, for example. The insertion of the appendage 136 into the recess 131 of the supporting member 130 may provide a more secure coupling of the shelf supporting member 135 to the supporting member 130. The more secure coupling may prevent the shelf 134 from being accidentally dislodged from the rack 100 (or reduce the chances of the shelf 134 being accidentally dislodged from the rack 100). For example, the more secure coupling may prevent the shelf 134 from sliding forward off of the supporting member 130 (and being dislodged from the rack 100) as a result of vibrations, incidental (or accidental) contact by a user, or any other incidental (or accidental) reason.

Additionally, although the appendage 136 may provide a more secure coupling, the appendage 136 may allow the shelf supporting member 135 (and the shelf 134) to be removed from the supporting member 130 of the rack 100. For example, when desired, the appendage 136 may be lifted out of the recess 131 (or otherwise removed from the recess 131), thereby allowing the shelf supporting member 135 (and the shelf 134) to be removed from the supporting member 130 of the rack 100.

The appendage 136 may have any shape. For example, the appendage 136 may have a cross section that is shaped as a rectangle, a square, a circle, an irregular shape, any other shape, or any combination of the preceding. The cross section of the appendage 136 may match (or be consistent) with the recess 131 of the supporting member 130. For example, the appendage 136 may have a cross section shaped as a circle, and the recess 131 may also be shaped as a slightly larger circle. The appendage 136 may also have any size.

The appendage 136 may be positioned at any location of the shelf supporting member 135. For example, the appendage 136 may be positioned on an upper inner surface of the shelf supporting member 135, as is illustrated in FIG. 4C. In such an example, the appendage 136 may extend downward from the upper inner surface of the shelf supporting member 135. As another example, the appendage 136 may be positioned on a side inner surface of the shelf supporting member 135, and may extend horizontally into a recess 131 positioned horizontally in the supporting member 130. In such an example (and in other examples), the appendage 136 may be spring loaded to assist in the insertion of the appendage 136 into the recess 131, and may further have a release mechanism (such as a manually operated knob, that may be pulled on by a user) that may allow the appendage 136 to be pulled out of the recess 131 (or otherwise removed from the recess 131).

As is discussed above, the shelf 134 may also have a support surface 136. The support surface 136 may be any surface that may support one or more items for display and/or storage. For example, the support surface 136 may be a flat, horizontal surface that may support one or more items for display and/or storage.

The support surface 136 may have any configuration. For example, the support surface 136 may be a solid surface, a surface with one or more gaps or holes in it, a mesh surface, two or more surfaces, or any combination of the preceding. As another example, the support surface 136 may made up of two or more spaced apart shelf members 137. A shelf member 137 may be any type of member that may form a surface of a shelf. For example, a shelf member 137 may be a rod, a bar, a panel, any other member that may form a surface of a shelf, or any combination of the preceding. The shelf member 137 may have any shape. For example, the shelf member 137 may have a cross section that is shaped as a rectangle, a square, a circle, an irregular shape, any other shape, or any combination of the preceding. The shelf member 137 may have any size. Additionally, the support surface 136 may include any number of shelf members 137. The shelf members 137 may be oriented in any manner to each other (e.g., parallel). Furthermore, the shelf members 137 may be spaced apart from each other by any distance. This spaced apart relation between the shelf members 137 may allow hooks (or attachment devices) to be positioned around a shelf member 137 and hang from the shelf member 137 (such as a hook that may hold a cooking vessel (such as a pot) or utensil so that the cooking vessel or utensil hangs from the shelf member 137), but may further allow items (such as plates, pots, pans, food stuffs, etc.) to be supported on top of the shelf members 137. Furthermore, all of the shelf members 137 may have the same shape and/or size, or only a portion of the shelf members 137 may have the same shape and/or size. As is illustrated, the shelf members 137 are bars with a circular cross section, and that are arranged parallel to each other.

The support surface 136 may be coupled to the shelf supporting members 135. By being coupled to the shelf supporting members 135, the support surface 136 may span the lateral space in-between two or more shelf supporting members 135, as is illustrated. The support surface 136 may be coupled to any portion of the shelf supporting members 135. For example, the support surface 136 may be coupled to the top surface of the shelf supporting members 135, to the sides of the shelf supporting members 135 (as is illustrated by shelf 134*b* of FIG. 4A), to the bottom of the shelf supporting members 135, to any other portion of the shelf supporting members 135, or any combination of the preceding. The support surface 136 may be coupled to the shelf supporting members 135 in any manner. For example, the support surface 136 (or each shelf member 137 of the support surface 136) may be bolted to the shelf supporting members 135, screwed to the shelf supporting members 135, riveted to the shelf supporting members 135, clipped or snapped into the shelf supporting members 135, welded to the shelf supporting members 135, bonded to the shelf supporting members 135, formed integral with the shelf supporting members 135, coupled to the shelf supporting members 135 in any other manner, or any combination of the preceding.

The shelf 134 may be made of (or constructed of) any material. For example, the shelf 134 may be made of steel, stainless steel, aluminum, iron, brass, titanium, any other metal or metal alloy, including coated, plated and clad metals, wood, plastic, any other material, or any combination of the preceding, including laminates. Furthermore, the shelf supporting members 135 and the support surface 136 may be made of the same material, or they may be made of different materials.

The rack 100 may include any number of shelves 134. For example, the rack 100 may include 1 shelf 134, 2 shelves 134, 3 shelves 134, 4 shelves 134, 6 shelves 134, 10 shelves 134, 20 shelves 134, or any other number of shelves 134. The number of shelves 134 included in the rack 100 may be based on the number and/or configuration of supporting members 130 of the rack 100. For example, the rack 100 may include a single shelf 134 for each supporting member 130, or a single shelf 134 for each group (e.g., a pair) of supporting members 130. As illustrated, the rack 100 includes a first shelf 134*a* for supporting members 130*a* and 130*c*, and a second shelf 134*b* for supporting members 130*b* and 130*d*. Although the rack 100 has been illustrated as including only two supporting members 130 supporting a shelf 134, the rack 100 may include any other number of supporting members 130 supporting a shelf 134 (or any other feature). For example, the rack 100 may include one or more additional supporting members 130 positioned horizontally in-between supporting members 130*a* and 130*b*. These additional supporting members 130 may allow the shelf 134*a* to hold additional weight and/or allow the shelf 134*a* to have a longer length, for example.

The shelf 134 may have any shape and/or any size. The shape and/or size of the shelf 134 may be based on the size of the brackets 110, the coupling members 120, and the supporting members 130. For example, the shelf 134 may have a length that is based on both the length of the coupling members 120 and the width of the brackets 110, and may further have a depth that is based on the length of the supporting members 130.

The shelf 134 may be modular, so as to allow it to be interchanged with other shelves 134 (or any other features, such as cooking appliances, cabinets, or drawers). For example, the solid shelf 134*a* may be interchanged with a shelf similar to shelf 134*b* having the set of bars arranged parallel to each other (or vice versa). As another example, the shelf 134 may be interchanged with a cooking appliance, a cabinet, a drawer, or any other kitchen feature.

The interchanging of shelves 134 (or other kitchen features) may be performed without removing the flue cap 145 of the vent flue 140 and/or without removing the brackets 110 (and thus the rack 100) from the vent flue 140 (or any other structure). For example, as is discussed above, the coupling of the shelf 134 to the rack 100 may be performed by sliding (or otherwise moving) the shelf supporting members 135 of the shelf 134 onto the supporting members 130 of the rack 100. Furthermore, such coupling may further include inserting (or otherwise positioning) the appendages 136 of the shelf supporting members 135 into the recesses 131 of the supporting members 130 (which may occur automatically, as a result of gravity for example, when the shelf supporting members 135 are slid (or otherwise moved) onto the supporting members 130). All of these actions may be performed while the brackets 110 remain coupled to the vent flue 140 and/or while the flue cap 145 remains coupled to the vent flue 140, for example.

Additionally, uncoupling the shelf 134 from the rack 100 may be performed by lifting the appendages 136 of the shelf supporting members 135 out of the recesses 131 of the supporting members 130 (which may occur by applying upward pressure on the shelf 134, for example) and sliding (or otherwise moving) the shelf supporting members 135 of the shelf 134 forward and off the supporting members 130 of the rack 100, for example. All of these actions may also be performed while the brackets 110 remain coupled to the vent flue 140 and/or while the flue cap 145 remains coupled to the vent flue 140, for example. As such, any of the shelves 134 may be interchanged with other shelves 134 (or other kitchen features) without removing the rack 100 from the vent flue 140 (or other structure). Furthermore, any of the shelves 134 may be temporarily (or permanently) removed from the rack 100 without removing the rack 100 from the vent flue 140 (or other structure). This may allow a user to more easily re-arrange the rack 100 to provide different storage abilities, to create additional (or different) working space in the kitchen (such as additional vertical space for a cook when a shelf is removed, for example), and/or to create additional (or different) appliance space in the kitchen, for example.

Although the shelf supporting members 135 have been described above as being slid (or otherwise moved) onto (or around) the supporting members 130, in other examples, the shelf supporting members 135 may be slid (or moved) into (or inside) a cavity in the supporting members 130. In such examples, the shelf supporting members 135 may be sized and/or shaped to fit inside the supporting members 130. Additionally, although the shelf supporting members 135 have been described above as including appendages 136 that may be inserted into recesses 131 in the supporting members 130, in other examples, the supporting members 130 may include the appendages 136, and the appendages 136 may be inserted into recesses 131 in the shelf supporting members 135. For example, the supporting members 130 may include appendages 136 extending upward from the top surface of the supporting members 130, and the shelf supporting members 135 may have recesses 131 in the upper surface of the shelf supporting members 135.

Figure 5A:
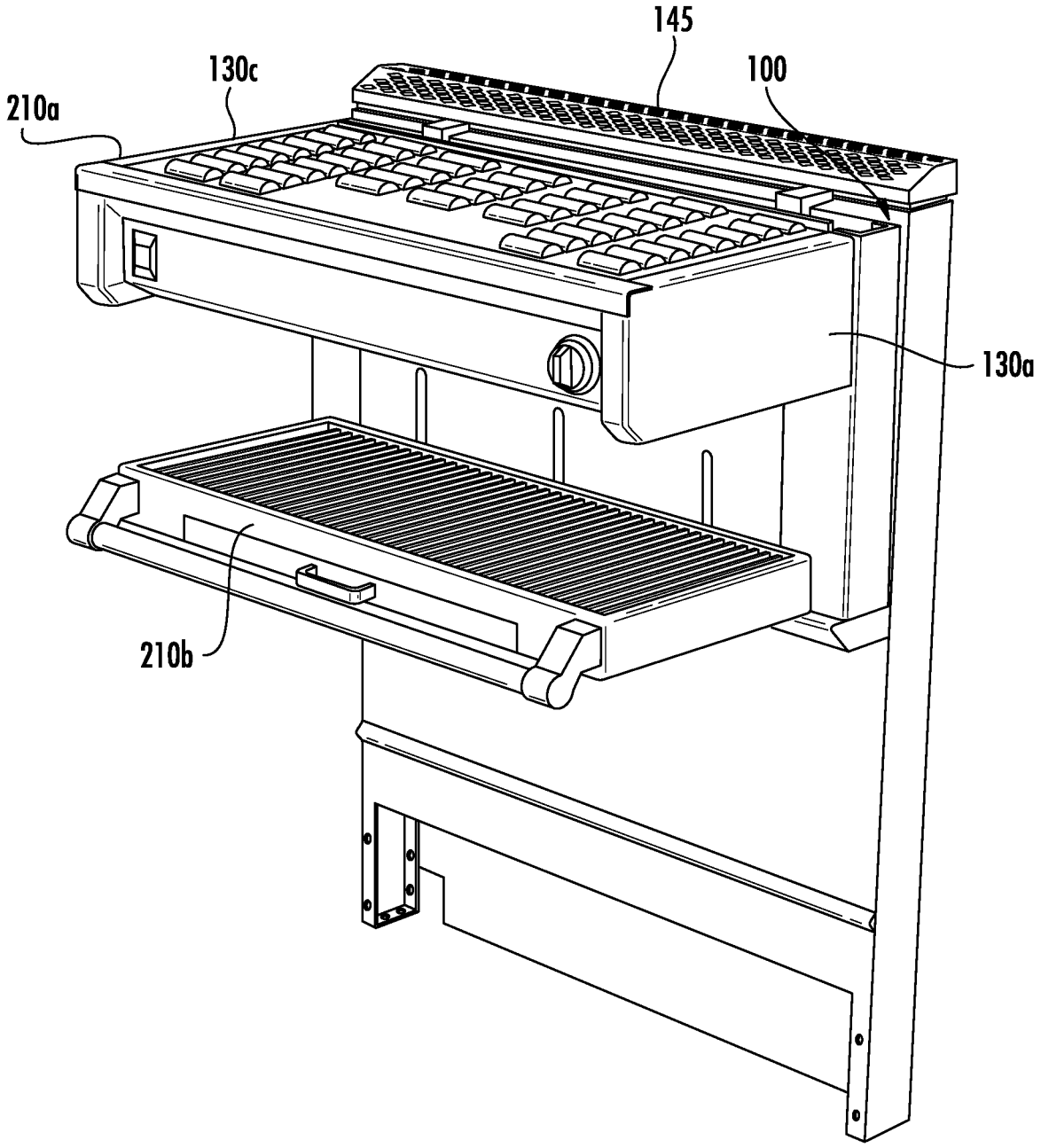
FIGS. 5A-5B illustrate an example of the kitchen rack of FIGS. 1A-1B coupled to a vent flue, and including a cooking appliance.
Figure 5B:
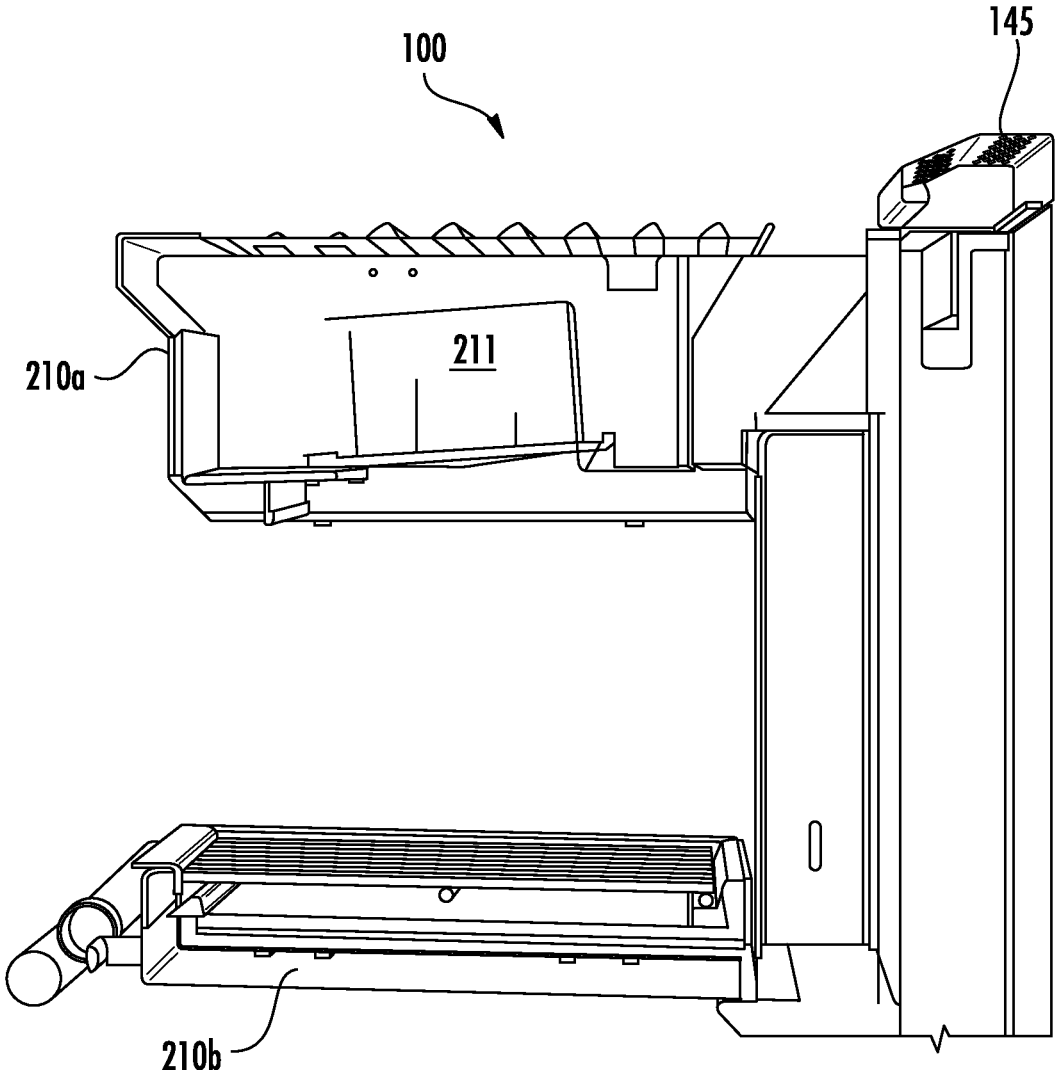

FIGS. 5A-5B illustrate an example of the kitchen rack of FIGS. 1A-1B coupled to a vent flue, and including a cooking appliances. In particular, FIG. 5A illustrates a front perspective view of a rack 100 coupled to a vent flue 140, and including a cooking appliance 210, and FIG. 5B illustrates a side view of the rack 100 coupled to the vent flue 140, and including a cooking appliance 210. The rack 100 may be substantially similar to the rack 100 described above with regard to FIGS. 1A-4B. Furthermore, the vent flue 140 may be substantially similar to the vent flue 140 described above with regard to FIGS. 3A-4B. However, as illustrated, the rack 100 further includes a cooking appliance 210.

A cooking appliance 210 may be any apparatus that may be used to cook food. For example, a cooking appliance 210 may be a broiler, a salamander, a cheesemelter, an oven, a cooking range, a microwave, a toaster, a warming tray or cavity, any other apparatus that may be used to cook food, or any combination of the preceding. A salamander may be a small self-contained broiler unit that may be used to finish or brown food. A cheesemelter may be a cooking appliance powered by direct flame or electricity, that allows a person to put finishing touches on food, especially food topped with shredded cheese. As illustrated, the rack 100 includes cooking appliances 210*a* and 210*b* for a salamander. In particular, the salamander cooking appliances include a broiler 210*a* and a food supporting shelf 210*b* (such as a salamander cooking surface 210*b*) positioned under the broiler 210*a*. In such an example, the broiler 210*a* may radiate heat down towards the food supporting shelf 210*b*, causing food on the food supporting shelf 210*b* to be cooked.

The cooking appliance 210 may be modular, so as to allow it to be interchanged with other cooking appliances 210 (or any other features, such as shelves, cabinets, or drawers). For example, cooking appliances 210 for a salamander may be interchanged with cooking appliances 210 for a cheesemelter, or vice versa. In such an example, the broiler 210*a* may not be changed, as the broiler 210*a* may be identical for both the salamander and the cheesemelter. In particular, the broiler 210*a* for both the salamander and the cheesemelter may produce equal power, British thermal units (BTUs), and broiling performance, and may have identical (and identically located) atmospheric gas infrared burners, valves, and other plumbing components included in a combustion chamber 211. Instead, to interchange the cooking appliances 210 to a cheesemelter, two 5-position ladder racks and a rear supporting module (or other food supporting shelf 210*b*) may be attached underneath the broiler 210*a* as salamander cooking surface 210*b*. Alternatively, to interchange the cooking appliances 210 to a salamander, an adjustable counter-balanced rack module (or other food supporting shelf 210*b*) may be attached underneath the broiler 210*a* as salamander cooking surface 210*b*. Furthermore, to interchange the salamander cooking appliances 210 to another cooking appliance 210 (such as a microwave, or any other feature) or other cooking appliances 210, both of the salamander cooking appliances 210*a* and 210*b* may be removed and interchanged with the new cooking appliance 210 (such as the microwave, or other feature). Such interchangeability between the cooking appliances 210 (and/or any other features, such as shelves, cabinets, or drawers) may allow the flexibility to switch between cooking appliances 210 (and/or other features) even after kitchen installation. Therefore, the rack 100 may be modified as the needs of the kitchen change, thereby reducing replacement costs, labor costs, down times, and/or complexity, for example.

The cooking appliance 210 may have any configuration. For example, as illustrated, the salamander cooking appliances 210 (and/or the cheesemelter cooking appliances 210) have sides and a bottom that are open. In such an example, the cooking appliances 210 do not include any sides in the gap in-between the broiler 210*a* and the food supporting shelf 210*b*. As such, unlike traditional salamanders and cheesemelters, the cooking appliances 210 have a configuration (e.g., no sides) that may not block the side view of the user of the cooking appliances 210, and further have a configuration that may not trap the exhaust gas flue products within the cooking appliances 210 (which may cause traditional cooking appliances to "bake" the food, as opposed to correctly "broiling" the food). Furthermore, the food supporting shelf 210*b* has no bottom below the cooking surface and the drip tray of the cooking surface. As such, unlike traditional salamanders and cheesemelters, the cooking appliances 210 have a configuration (e.g., no bottom) that may not block the view of the user of the cooking appliances 210, and further have a configuration that provides structural support to the cooking appliances 210 through the rack 100 (e.g., support members 130) coupled to the vent flue 140, as opposed to structural support being provided by the bottom of the cooking appliances, as is the case in traditional salamanders and cheesemelters.

The rack 100 may include any number of cooking appliances 210. For example, the rack 100 may include 1 cooking appliance 210, 2 cooking appliances 210, 3 cooking appliances 210, 4 cooking appliances 210, 6 cooking appliances 210, 10 cooking appliances 210, 20 cooking appliances 210, or any other number of cooking appliances 210. The number of cooking appliances 210 included in rack 100 may be based on the number and/or configuration of supporting members 130 of the rack 100. For example, the rack 100 may include a cooking appliance 210 for each supporting member 130, or a single cooking appliance 210 for each group (e.g., a pair) of supporting members 130. As illustrated, the rack 100 includes a first salamander cooking appliance 210 (i.e., broiler 210*a*) for supporting members 130*a* and 130*c*, and further includes a second salamander cooking appliance 210 (i.e., food supporting shelf 210*b*) for supporting members 130*b* and 130*d*.

The cooking appliance 210 may have any shape and/or any size. The shape and/or size of the cooking appliance 210 may be based on the size of the brackets 110, the coupling members 120, and the supporting members 130. For example, the cooking appliance 210 may have a length that is based on both the length of the coupling members 120 and the width of the brackets 110, and may further have a width that is based on the length of the supporting member 130.

The cooking appliance 210 may be supported by supporting members 130, or the supporting members 130 may be a portion of the cooking appliance 210. For example, the cooking appliance 210 may be an attachment appliance that is coupled on top of, coupled below, coupled in-between, or inserted on the supporting members 130. In such an example, the supporting members 130 may support the cooking appliance 210. As another example, the supporting members 130 may be a portion of the cooking appliance 210. In such an example, the supporting members 130 may form an outside portion of the cooking appliance 210, with the internal components of the cooking appliance forming the remaining portion of the cooking appliance 210.

As a result of the cooking appliance 210 being supported by supporting members 130 (or the supporting members 130 being a portion of the cooking appliance 210), the cooking appliance 210 may be coupled to the vent flue 140 by the rack 100. As is discussed above with regard to FIGS. 1A-3E, such a coupling may be provided by brackets 110 (without the use of bolts or any other permanent-type coupling). As a result, the rack 100 (and the cooking appliances 210) may be moved. For example, the rack 100 (and the cooking appliances 210) may be moved laterally along the vent flue 140 without uncoupling the rack 100 from the vent flue 140. Furthermore, the rack 100 (and the cooking appliances 210) may also be more easily uncoupled from the vent flue 140 and moved to an entirely different structure (or to another section of the same vent flue 140). This may provide complete horizontal movement of the cooking appliances 210, giving endless flexibility to place the cooking appliances 210 anywhere in the cooking line for maximum functionalities and possibilities.

Additionally, as result of this horizontal (or other) movement and also the interchangeability of the cooking appliances 210 (as is discussed above), a user may be able more easily move, remove, or even add cooking appliances 210 (and/or other features, such as shelves, drawers, or cabinets) if there are any changes in the food cooking process, preparing process, or in chef or restaurant ownership. This may provide substantial cost savings when a foodservice operator needs to move cooking appliances 210. In particular, since the cooking appliance 210 can be moved along the vent flue 140 (or other structure) freely without permanent hardware, major modifications, or replacement of the vent flue 140, there may be no replacement cost. Additionally, labor cost, down time, and the complexities of re-configuring a kitchen may be substantially reduced.

Figures 6A, 6B:
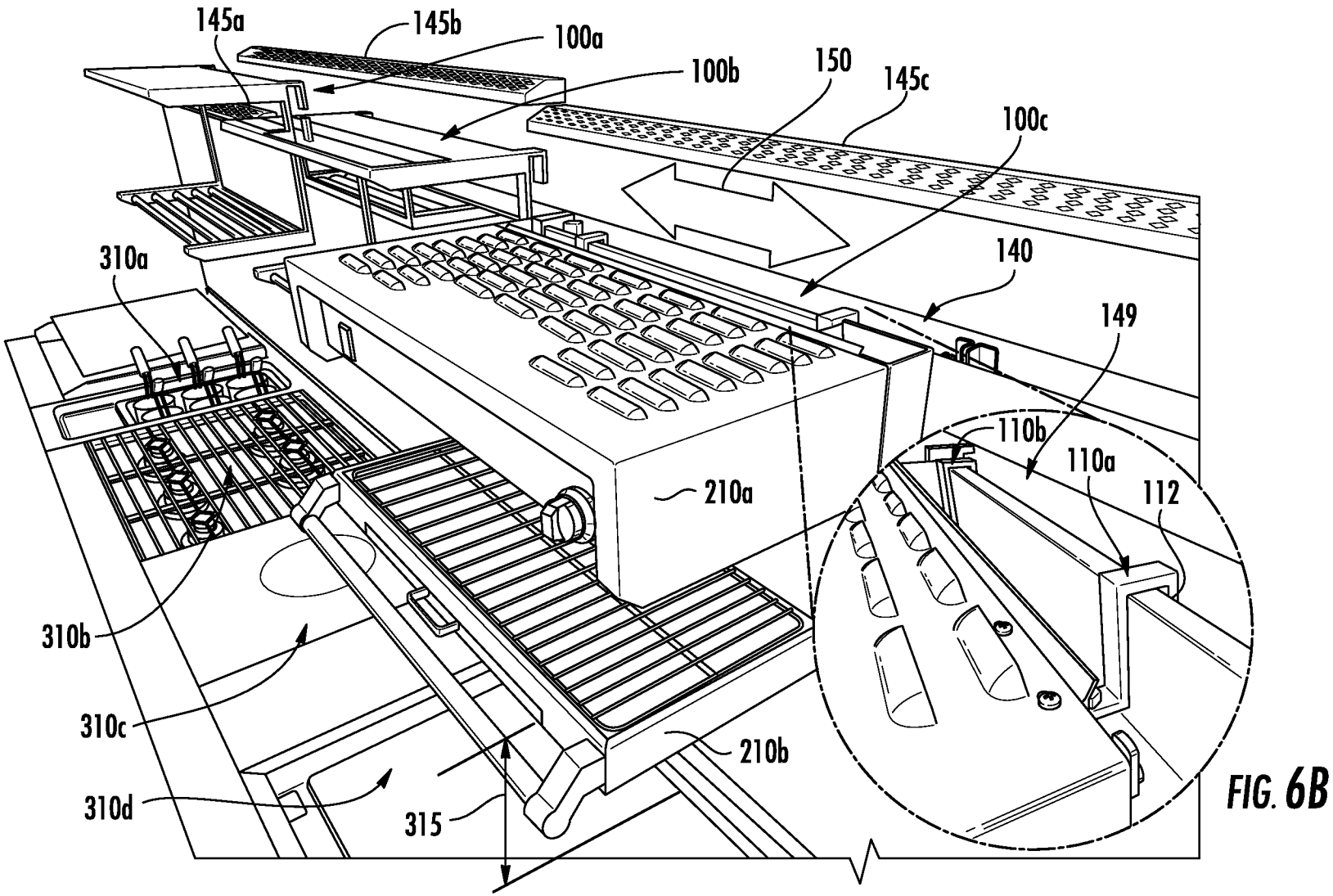
FIGS. 6A-6B illustrate an example of a kitchen area that utilizes a kitchen rack.

FIGS. 6A-6B illustrate an example of a kitchen area that utilizes a kitchen rack. In particular, FIG. 6A illustrates a partially assembled perspective view of a kitchen area 300 that utilizes racks 100 and a vent flue 140; and FIG. 6B illustrates an enlarged view of the encircled portion of FIG. 6A. The kitchen area 300 may be any area of any type of kitchen. For example, the kitchen area 300 may be a portion of a cooking line in a food industry kitchen.

As illustrated, the kitchen area 300 includes racks 100. The racks 100 may be substantially similar to the rack 100 described above with regard to FIGS. 1A-4B. Furthermore, the kitchen area 300 may include any number of racks 100. For example, the kitchen area 300 may include 1 rack 100, 2 racks 100, 3 racks 100, 4 racks 100, 5 racks 100, 10 racks 100, 20 racks 100, or any other number of racks 100. As illustrated, the kitchen area 300 includes 3 racks 100. The first rack 100*a* and the second rack 100*b* each include 2 shelves (such as shelves 132 discussed above). The third rack 100*c* includes cooking appliances 210*a* and 210*b* for a salamander. In particular, the salamander cooking appliances include a broiler 210*a* and a food supporting shelf 210*b* (such as a salamander cooking surface 210*b*) positioned under the broiler 210*a*. In such an example, the broiler 210*a* may radiate heat down towards the food supporting shelf 210*b*, causing food on the food supporting shelf 210*b* to be cooked.

The kitchen area 300 further includes a vent flue 140. The vent flue 140 may be substantially similar to the vent flue 140 described above with regard to FIGS. 3A-4B. Furthermore, the kitchen area 300 may include any number of vent flues 140. For example, the kitchen area 300 may include 1 vent flue 140, 2 vent flues 140, 3 vent flues 140, 4 vent flues 140, 5 vent flues 140, 10 vent flues 140, 20 vent flues 140, or any other number of vent flues 140. As illustrated, the kitchen area 300 includes a single vent flue 140 that extends laterally along the entire length of the kitchen area 300. As discussed above with regard to FIGS. 3A-4B, the vent flue 140 may include one or more support bars 144, and one or more vent caps 145 coupled to the vent flue 140.

As is illustrated, the racks 100 may be coupled to the vent flue 140. A rack 100 (such as rack 100*c*) may be coupled to the vent flue 140 in any manner. For example, the rack 100 may be coupled to the vent flue 140 by inserting the brackets 110 of the rack 100 into the upper opening 149 of the cavity 143 of the vent flue 140, as is discussed above with regard to FIG. 3E. When coupled to the vent flue 140, the rack 100 may be moved laterally (as is illustrated by arrow 150) along the length of the vent flue 140 even while the vent cap 145 (such as each of vent caps 145*a*-145*c*) is coupled to the vent flue 140.

As illustrated, the kitchen area 300 further includes kitchen appliances 310. A kitchen appliance 310 may be any apparatus that may be used in a kitchen (such as to cook food). For example, a kitchen appliance 310 may be a fryer, a grill, a cooking range (such as a French Top cooking range), an oven, a smoker, a table top, a dishwasher, a sink, a trash compactor, any other apparatus that may be used in a kitchen, or any combination of the preceding.

The kitchen area 300 may include any number of kitchen appliances 310. For example, the kitchen area 300 may include 1 kitchen appliance 310, 2 kitchen appliances 310, 3 kitchen appliances 310, 4 kitchen appliances 310, 6 kitchen appliances 310, 10 kitchen appliances 310, 20 kitchen appliances 310, or any other number of kitchen appliances 310. As illustrated, the kitchen area 300 includes a fryer as a first cooking appliance 310*a*, a grill as a second cooking appliance 310*b*, a French Top cooking range as a third cooking appliance 310*c*, and an oven as a fourth cooking appliance 310*d*.

The kitchen appliance 310 may be in fluid communication with the vent flue 140. For example, as is illustrated, the fourth cooking appliance 310*d* is an oven. This oven may be a gas combustion oven. Furthermore, a portion of the combustion gases of the oven (such as the hot combustion exhaust gases) may be directed from the oven into the vent flue 140, so as to vent out of the cavity 149 of the vent flue 140. As such, these hot combustion exhaust gases may be vented near ceiling vents, for example, in the kitchen area 300. Any number of the kitchen appliances 310 in the kitchen area 300 may be in fluid communication with the vent flue 140. For example, only one kitchen appliance 310 may be in fluid communication with the vent flue 140, none of the kitchen appliances 310 may be in fluid communication with the vent flue 140, all of the kitchen appliances 310 may be in fluid communication with the vent flue 140, or any other number of kitchen appliances 310 may be in fluid communication with the vent flue 140.

The rack 100 and the kitchen appliance 310 may be positioned in any manner with respect to each other. For example, the rack 100 may be positioned directly above the kitchen appliance 310, laterally to left of the kitchen appliance 310, laterally to right of the kitchen appliance 310, half above the kitchen appliance 310 and half above another area of the kitchen area 300, or positioned at any other location with respect to the kitchen appliance 310. Furthermore, because the lateral position of the rack 100 may be changed (such as by sliding the rack laterally alone the vent flue 140), the positioning of the rack 100 with respect to the kitchen appliance 310 may also be changed. As is illustrated, the rack 100*c* (including cooking appliances 210*a* and 210*b* supported by supporting members 130*a*-130*d*) is positioned above the oven kitchen appliance 310*d*).

The rack 100 may further be positioned with respect to a kitchen appliance 310 so as to have a vertical spacing in-between the rack 100 and the kitchen appliance 310. For example, the rack 100 may be positioned so that there is a vertical spacing 315 in-between the top of the kitchen appliance 310 (such as the top of the oven kitchen appliance 310*d*) and the lowest supporting members 130 of the rack 100 (which are illustrated with regard to rack 100*c* as supporting food supporting shelf 210*b*). This vertical spacing 315 may be any distance. For example, the vertical spacing 315 may be 6 inches, 1 foot, 1.5 feet, 2 feet, 2.5 feet, 3 feet, 4 feet, 5 feet, or any other distance. As another example, the vertical spacing 315 may be approximately (i.e., +/−3 inches) 6 inches, approximately 1 foot, approximately 1.5 feet, approximately 2 feet, approximately 2.5 feet, approximately 3 feet, approximately 4 feet, approximately 5 feet, or any other approximate distance. The vertical spacing 315 may create a work space in-between the top of the kitchen appliance 310 and the lowest supporting members 130 of the rack 100. This work space may allow kitchen personnel to use the top of the kitchen appliance 310 (such as use the top of the kitchen appliance 310 to cook food, prepare food, or store dishes) without running into a portion of the rack 100.

The rack 100 and the kitchen appliance 310 may further be positioned in any manner with respect to the vent flue 140. For example, the rack 100 (and/or the kitchen appliance 310) may be positioned in the middle of the length of the vent flue 140, on the left of the length of the vent flue 140, on the right of the length of the vent flue 140, or any other position along the length of the vent flue 140. Additionally, due to the lateral size of the vent flue 140, the vent flue 140 may extend laterally beyond the length of the rack 100, the kitchen appliance 310, or both the rack 100 and the kitchen appliance 310. As such, the rack 100 may be moved laterally along the length of the vent flue 100 to be positioned at any location with respect to the kitchen appliance 310, as is discussed above.

Modifications, additions, combinations, or omissions may be made to the rack 100, shelves 132, shelves 134, vent flue 140, cooking appliances 210, kitchen appliances 310, and/or any other elements of FIGS. 1A-6B without departing from the scope of the disclosure. For example, any number of racks 100 (e.g., two or more racks 100) may be coupled to a vent flue 140 (or any other structure). Additionally, any of the elements of any of FIGS. 1A-6B may be added to, combined with, or substituted for any of the elements of any other of the FIGS. 1A-6B. For example, a rack 100 may include one or more shelves 132 of FIGS. 2A-2B, and may further include one or more cooking appliances 210 of FIGS. 5A-5B (and/or one or more other features of FIGS. 1A-6B).

Figure 7:
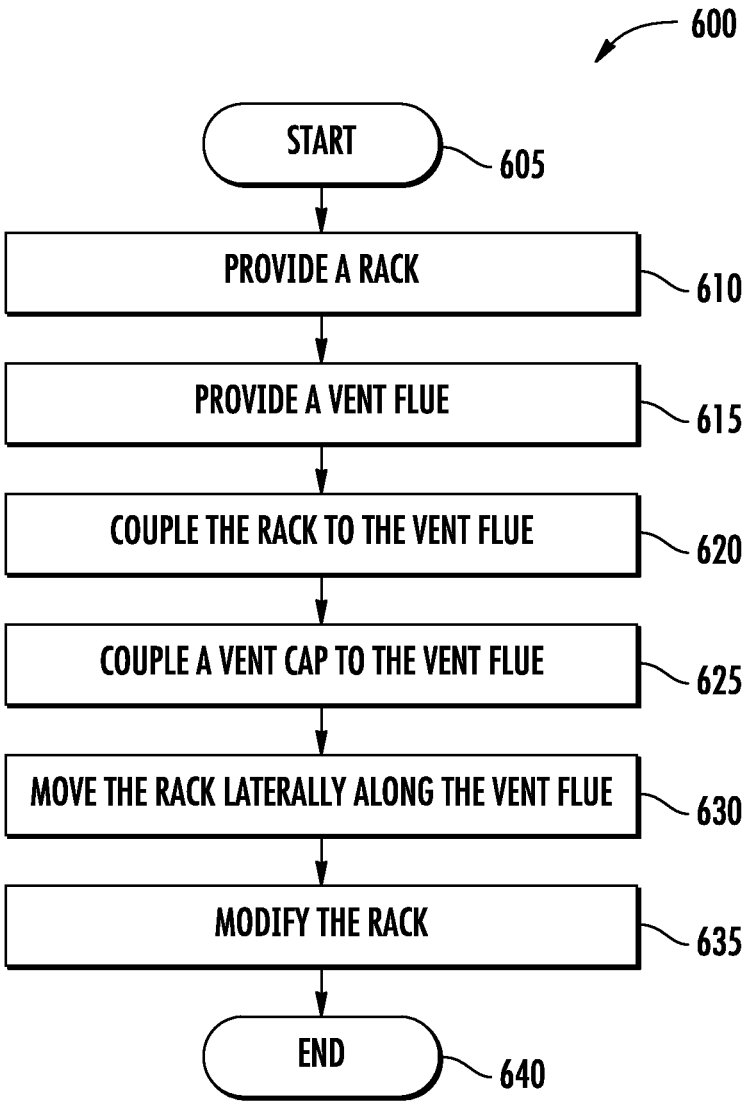
FIG. 7 illustrates an example method of installing and/or using a kitchen rack.

FIG. 7 illustrates an example method of installing and/or using a kitchen rack. One or more of the steps (such as all of the steps) of method 600 may be performed using the rack 100 of FIGS. 1A-6B, the vent flue 140 of FIGS. 3A-6B, and/or any of the other elements of FIGS. 1A-6B. Furthermore, one or more of the steps (such as all of the steps) of method 600 may be performed by a manufacturer of a kitchen rack, a re-seller of a kitchen rack, a shipper of a kitchen rack, an installer of a kitchen rack, and/or a user of a kitchen rack. Additionally, one or more of the steps of method 600 may be performed by different entities.

The method 600 begins at step 605. At step 610, a rack 100 may be provided. The rack 100 may be provided in any manner. For example, the rack 100 may be built, purchased, shipped, acquired, received, provided in any other manner, or any combination of the preceding.

The rack 100 may be provided with one or more features already added to the rack 100. For example, any number of features, such as shelves 132, cabinets, drawers, and/or cooking appliances 210 may already be added to the rack 100. Alternatively, the step 610 may further include adding one or more features to the rack 100. The features may be added in any manner to the rack. For example, the supporting members 130 may support the features. In such an example, the feature (such as a shelf 132) may be coupled on top of, coupled below, coupled in-between, or inserted on the supporting members 130. FIGS. 2A-2B provide one example of a shelf 132 supported by supporting members 130, and FIGS. 5A-5B provide one example of a cooking appliance 210 supported by supporting members 130. As another example, the supporting members 130 may be a portion of the feature. In such an example, the supporting members 130 may form an outside portion of the feature (such as a shelf 132), with other portions of the feature forming the remainder of the feature. FIGS. 2A-2B provide one example of a shelf 132 with supporting members 130 that form portions of the shelf 132.

At step 615, a vent flue 140 may be provided. The vent flue 140 may be provided in any manner. For example, the vent flue 140 may be built, purchased, shipped, acquired, received, installed, provided in any other manner, or any combination of the preceding.

The vent flue 140 may be provided with one or more support bars 144 already added to the vent flue 140. Alternatively, the step 615 may further include adding one or more support bars 144 to the vent flue 140. A support bar 144 may be positioned at any location within the cavity 143 of the vent flue 140. For example, the support bar 144 may be coupled to the rear face of the front wall 141 of the vent flue 140. The support bar 144 may also be positioned at any height within the cavity 143 of the vent flue 140. For example, the support bar 144 may be coupled adjacent to the first height of the front wall 141. In such an example, the top surface of the support bar 144 may be level or approximately (i.e., +/−0.1 inches) level with the top surface of the front wall 141, as is illustrated in FIG. 3B. Additionally, the support bar 144 may be coupled to the vent flue 140 (such as the rear face of the front wall 141 of the vent flue 140) in any manner. For example, the support bar 144 may be bolted to the vent flue 140, screwed to the vent flue 140, riveted to the vent flue 140, clipped or snapped into the vent flue 140, welded to the vent flue 140, bonded to the vent flue 140, formed integral with the vent flue 140, coupled to the vent flue 140 (such as the rear face of the front wall 141 of the vent flue 140) in any other manner, or any combination of the preceding.

At step 620, the rack 100 may be coupled to the vent flue 140. The rack 100 may be coupled to the vent flue 140 in any manner. For example, the rack 100 may be coupled to the vent flue 140 by inserting the brackets 110 of the rack 100 into the upper opening 149 of the cavity 143 of the vent flue 140. By doing so, the rear leg 112 of the bracket 110 may be inserted between the front wall 141 and the back wall 142 of the vent flue 140, and be positioned against the back surface of the support bar 144, as is illustrated in FIG. 3E. Additionally, the support bar 144 may be positioned within the gap 114 in-between the rear leg 112 and the front leg 113, as is also illustrated in FIG. 3E. Furthermore, the front leg 113 of the bracket 110 may be positioned against the front face of the front wall 141, and the top portion 111 of the bracket 110 may be positioned against the top surface of the front wall 141 and the top surface of the support bar 144, as is also illustrated in FIG. 3E. Such a coupling may cause the coupling members 120 to be positioned against the front face of the front wall 141, thereby causing the second plane 125 (in which the coupling members 120 and the front legs 113 are disposed) to be oriented parallel to the front wall 141.

At step 625, a vent cap 125 may be coupled to the vent flue 140. The vent cap 145 may be coupled to the vent flue 140 at any location that allows the vent cap 145 to vent gases out of the cavity 143. For example, as is illustrated, the vent cap 145 may be coupled on top of the vent flue 140 so as to be located above the upper opening 149 of cavity 143 of the vent flue 140. In such an example, the vent cap 145 may cover the vent flue 145. The vent cap 145 may be coupled to the vent flue 140 in any manner. For example, the vent cap 145 may be bolted to the vent flue 140, screwed to the vent flue 140, nailed to the vent flue 140, clipped to the vent flue 140, welded to the vent flue 140, formed integral with the vent flue 140, coupled to the vent flue 140 in any other manner, or any combination of the preceding. Although the vent cap 145 may be coupled to the vent flue 140, such a coupling preferably does not block, cover, or otherwise impede a portion of the height gap 151 in-between the first height of the front wall 141 and the second height of the back wall 142. For example, the height gap 151 (or a portion of the height gap 151) may create a spacing in-between the top edge of the front wall 141 and the bottom edge of the vent cap 145. This spacing may create a continuous horizontal slot that may allow the rack 100 to be coupled to the vent flue 140 and that may also allow the rack 100 to be moved laterally (as is illustrated by arrow 150 of FIG. 3A) along the length of the vent flue 140 even while the vent cap 145 is coupled to the vent flue 140.

At step 630, the rack 100 may be moved laterally along the vent flue 140. An example of such lateral movement is illustrated by arrow 150 of FIG. 3A. The rack 100 may be moved laterally along the vent flue 140 in any manner. For example, the rack 100 may be physically pushed laterally, causing the brackets 110 to move laterally inside of the cavity 143. Furthermore, the rack 100 may be moved laterally along the vent flue 140 without uncoupling the rack 100 from the vent flue 140 and/or without uncoupling the vent cap 145 from the vent flue 140. The rack 100 may be moved laterally along any distance of the vent flue 140, such as the entire length of the vent flue 140. This may provide complete horizontal movement of the rack 100 (and any features, such as shelves 132, cabinets, drawers, and/or cooking appliances 210), giving endless flexibility to place the rack 100 (and any features) anywhere in the cooking line for maximum functionalities and possibilities.

At step 635, the rack 100 may be modified. For example, one or more of the features (such as shelves 132, cabinets, drawers, and/or cooking appliances 210) may be added to the rack 100, removed from the rack 100, or interchanged for (or substituted for) other features (e.g., a cooking appliance 210 may be interchanged with a shelf 132, or a different cooking appliance 210). Such modification may allow the flexibility to change and/or switch between cooking appliances 210 (and/or other features) even after kitchen installation. Therefore, the rack 100 may be modified as the needs of the kitchen change, thereby reducing replacement costs, labor costs, down times, and/or complexity, for example. At step 640, the method 600 ends.

Modifications, additions, or omissions may be made to method 600. For example, the method 600 may not include one or more of the steps. Additionally, the steps of method 600 may be performed in parallel or in any suitable order.

This specification has been written with reference to various non-limiting and non-exhaustive embodiments or examples. However, it will be recognized by persons having ordinary skill in the art that various substitutions, modifications, or combinations of any of the disclosed embodiments or examples (or portions thereof) may be made within the scope of this specification. Thus, it is contemplated and understood that this specification supports additional embodiments or examples not expressly set forth in this specification. Such embodiments or examples may be obtained, for example, by combining, modifying, or reorganizing any of the disclosed steps, components, elements, features, aspects, characteristics, limitations, and the like, of the various non-limiting and non-exhaustive embodiments or examples described in this specification. In this manner, Applicant reserves the right to amend the claims during prosecution to add features as variously described in this specification.

What is claimed is:

1. A shelving system comprising:

a. a rack comprising:

i. a pair of spaced apart inverted U shaped brackets, each U shaped bracket having a top portion coupled in-between a rear leg and a front leg and forming a gap in-between the rear leg and the front leg, wherein the top portion, the rear leg, and front leg of each U shaped bracket are disposed in a first plane;

ii. one or more horizontal coupling members coupled in-between the pair of U shaped brackets, wherein the one or more horizontal coupling members and the front leg of each U shaped bracket are disposed in a second plane that is orthogonal to the first plane;

iii. one or more first horizontal supporting members coupled to and extending outward from a first U shaped bracket of the pair of U shaped brackets, wherein the one or more first horizontal supporting members are disposed in a third plane that is orthogonal to the first and second planes; and iv. one or more second horizontal supporting members coupled to and extending outward from a second U shaped bracket of the pair of U shaped brackets, wherein the one or more second horizontal supporting members are disposed in a fourth plane that is parallel to the third plane; and b. a pair of shelf supporting members, a first shelf supporting member of the pair of shelf supporting members having a cavity configured to receive one of the one or more first horizontal supporting members, a second shelf supporting member of the pair of shelf supporting members having a cavity configured to receive one of the one or more second horizontal supporting members, wherein a lateral support surface spans a lateral space in-between the pair of shelf supporting members, wherein the lateral support surface comprises a solid surface that spans the entire depth of the pair of shelf supporting members.

2. The shelving system of claim 1, wherein the pair of shelf supporting members each have an upper internal surface and a downward extending appendage extending from the upper internal surface, wherein each of the one of the one or more first horizontal supporting members and the one of the one or more second horizontal supporting members has a top surface with a recess positioned in the top surface, wherein each recess is configured to receive one of the downward extending appendages to latch the pair of shelf supporting members to the one of the one or more first horizontal supporting members and the one of the one or more second horizontal supporting members.

3. The shelving system of claim 2, wherein each of the one of the one or more first horizontal supporting members and the one of the one or more second horizontal supporting members comprises a bar having a hollow core and a respective recess extending into the hollow core.

4. The shelving system of claim 1, wherein:

a. the first shelf supporting member of the pair of shelf supporting members comprises a sleeve configured to be positioned over or around the one of the one or more first horizontal supporting members; and b. the second shelf supporting member of the pair of shelf supporting members comprises a sleeve configured to be positioned over or around the one of the one or more second horizontal supporting members.

5. The shelving system of claim 1, wherein the solid surface is welded to the pair of shelf supporting members.

* * * * *